US009808925B2

(12) United States Patent
Yamada et al.

(10) Patent No.: US 9,808,925 B2
(45) Date of Patent: Nov. 7, 2017

(54) IMPACT TOOL

(71) Applicant: HITACHI KOKI CO., LTD., Tokyo (JP)

(72) Inventors: Hideki Yamada, Hitachinaka (JP); Takahiro Ookubo, Hitachinaka (JP); Satoshi Abe, Hitachinaka (JP)

(73) Assignee: HITACHI KOKI CO., LTD., Tokyo (JP)

( * ) Notice: Subject to any disclaimer, the term of this patent is extended or adjusted under 35 U.S.C. 154(b) by 459 days.

(21) Appl. No.: 14/378,601

(22) PCT Filed: Mar. 19, 2013

(86) PCT No.: PCT/JP2013/001879

§ 371 (c)(1),
(2) Date: Aug. 13, 2014

(87) PCT Pub. No.: WO2013/140793

PCT Pub. Date: Sep. 26, 2013

(65) Prior Publication Data

US 2016/0052119 A1 Feb. 25, 2016

(30) Foreign Application Priority Data

Mar. 22, 2012 (JP) ..... 2012-065221
Mar. 30, 2012 (JP) ..... 2012-083195
(Continued)

(51) Int. Cl.
*B25D 17/24* (2006.01)
*B25D 11/00* (2006.01)
*B25D 17/20* (2006.01)

(52) U.S. Cl.
CPC ..... *B25D 17/24* (2013.01); *B25D 11/00* (2013.01); *B25D 17/20* (2013.01);
(Continued)

(58) Field of Classification Search
CPC ..... B25D 17/24; B25D 11/00; B25D 17/20; B25D 2211/006; B25D 2211/0061;
(Continued)

(56) References Cited

U.S. PATENT DOCUMENTS 7,500,527 B2 * 3/2009 Fischer ..... B25D 17/043 173/162.2
7,513,317 B2 * 4/2009 Satou ..... B25D 17/24 173/109
(Continued)

FOREIGN PATENT DOCUMENTS

CN 101484280 A 7/2009
CN 101646529 A 2/2010
(Continued)

OTHER PUBLICATIONS

International Search Report and Written Opinion issued in International Application No. PCT/JP2013/001879 dated Jun. 14, 2013.
(Continued)

*Primary Examiner* — Michelle Lopez
(74) *Attorney, Agent, or Firm* — McDermott Will & Emery LLP

(57) ABSTRACT

An impact tool includes a casing (13) supporting a tip tool (12), a piston (41) provided in the casing (13), an electric motor (11) provided in the casing (13), a motion converting mechanism (45) provided in the casing (13), and a vibration reducing mechanism (47) provided in the casing (13). The vibration reducing mechanism (47) has a supporting member, which is swingable with using a fixing position (J) as a supporting point and a weight (49) attached to a free end side of the supporting member. In a plane including a center line (C), the gravity center (H) of the weight (49) and the gravity center (G) of the casing (13) are disposed at mutually different locations, and the fixing position (J) is disposed on the side of the gravity center (G) relative to the center line (C).

16 Claims, 16 Drawing Sheets

(30) Foreign Application Priority Data

| | | |
|---|---|---|
| Mar. 30, 2012 | (JP) | 2012-083196 |
| Mar. 30, 2012 | (JP) | 2012-083217 |
| Sep. 28, 2012 | (JP) | 2012-218648 |

(52) U.S. Cl.
CPC .. *B25D 2211/006* (2013.01); *B25D 2211/061* (2013.01); *B25D 2217/0061* (2013.01); *B25D 2217/0092* (2013.01); *B25D 2222/57* (2013.01); *B25D 2250/245* (2013.01); *B25D 2250/331* (2013.01); *B25D 2250/391* (2013.01)

(58) Field of Classification Search
CPC ..... B25D 2217/0092; B25D 2250/391; B25D 2217/0073; B25S 2217/0076
USPC ..... 173/48, 162.1, 162.2
See application file for complete search history.

(56) References Cited

U.S. PATENT DOCUMENTS

| | | | | |
|---|---|---|---|---|
| 2004/0206520 | A1 | 10/2004 | Ikuta | |
| 2009/0068936 | A1 | 3/2009 | Kuhnle et al. | |
| 2009/0218114 | A1 | 9/2009 | Ohlendorf et al. | |
| 2010/0270046 | A1 | 10/2010 | Schlesak et al. | |
| 2011/0017483 | A1* | 1/2011 | Baumann | B25D 11/062 173/162.2 |
| 2012/0055689 | A1 | 3/2012 | Wierer et al. | |

FOREIGN PATENT DOCUMENTS

| | | | |
|---|---|---|---|
| EP | 2072191 | A1 | 6/2009 |
| JP | 61-178188 | A | 8/1986 |
| JP | 2007-237301 | A | 9/2007 |
| JP | 2007-237304 | A | 9/2007 |
| JP | 2008155369 | A | 7/2008 |
| JP | 2008-272897 | A | 11/2008 |
| JP | 2009142985 | A | 7/2009 |
| WO | 2007/102449 | A1 | 9/2007 |
| WO | 2007/105742 | A1 | 9/2007 |

OTHER PUBLICATIONS

Notification of Reasons for Refusal Japanese Patent Application No. 2012-083195 dated May 12, 2015 with English translation.
Notification of the First Office Action Chinese Patent Application No. 2013800090459 dated Jul. 17, 2015 with English translation.
Notification of Reasons for Refusal dated Aug. 11, 2015, issued in Japanese Patent Application No. 2012-218648, with English language translation.

* cited by examiner

*(A)*

*(B)*

IMPACT TOOL

RELATED APPLICATIONS

This application is the U.S. National Phase under 35 U.S.C. §371 of International Application No. PCT/JP2013/001879, filed on Mar. 19, 2013, which in turn claims the benefit of Japanese Application No. 2012-065221, filed on Mar. 22, 2012, Japanese Application No. 2012-083217, filed Mar. 30, 2012, Japanese Application No. 2012-083195, filed on Mar. 30, 2012, Japanese Application No. 2012-083196, filed on Mar. 30, 2012 and Japanese Application No. 2012-218648, filed on Sep. 28, 2012, the disclosures of which are incorporated by reference herein.

TECHNICAL FIELD

The present invention relates to an impact tool capable of applying an impact force to a tip tool like a hammer drill, a hammer driver, or others.

BACKGROUND ART

Conventionally, an impact tool such as a hammer drill or a hammer driver is capable of applying an impact force to a tip tool. Such an impact tool has: a casing; a tip tool which is rotated by an electric motor provided in the casing; a striker which is provided so as to be linearly reciprocable in the casing; a motion converting mechanism which converts rotary motion of the electric motor to reciprocating motion of a piston; and a striker which transmits the impact force generated by the reciprocating motion of the piston to the tip tool. In the impact tool, the casing vibrates due to the reciprocating motion of the piston, the movement of striking the tip tool by the striker, and others. For this reason, techniques by which the vibrations of the casing in the impact tool can be reduced have been proposed, and an example thereof is described in Patent Literature 1.

An impact tool described in Patent Literature 1 has a hollow casing, and the interior of the casing is separated into a first housing chamber, a second housing chamber, and a third housing chamber by two partition walls. An electric motor is provided in the first housing chamber. The electric motor has an output shaft, and is configured so that the output shaft is rotated when electric power of an external power supply is supplied.

Bearings are attached to the two partition walls, respectively, and a first intermediate shaft is supported by the bearing to be rotatable about a first center line. The first intermediate shaft is disposed across the second housing chamber and the third housing chamber. The output shaft and the first intermediate shaft are coaxially provided, and the output shaft and the first intermediate shaft are coupled so as to be integrally rotated. A first gear is provided at a part of the first intermediate shaft which is positioned in the third housing chamber.

Also, a second intermediate shaft is provided in the third housing chamber, and the second intermediate shaft is supported by two bearings to be rotatable about a second center line. The second intermediate shaft is provided with a second gear, and the first gear and the second gear mesh with each other. Furthermore, the second intermediate shaft is provided with a gear part. Moreover, the third housing chamber is provided with a cylinder having a cylindrical shape, and in the cylinder, a piston, a striker, an intermediate element, and a tip tool are inserted to be reciprocable in a direction along a third center line (center line) of the cylinder. A pneumatic chamber is formed between the piston and the striker in the cylinder. All of the first center line, the second center line, and the third center line are mutually parallel. The tip tool is provided so as to rotate integrally with the cylinder, and a tip of the tip tool is exposed to the outside of the cylinder. A third gear is attached to the cylinder, and the third gear and the gear part mesh with each other. Furthermore, a sleeve having a cylindrical shape is attached to an outer peripheral surface of the second intermediate shaft so as to be relatively rotatable with the second intermediate shaft. In the third housing chamber, a clutch which engages and releases the sleeve and the second intermediate shaft is provided. Moreover, the clutch is configured so that actuations are switched by the operation of a change lever. Furthermore, a motion converting mechanism which converts rotary motion of the sleeve to reciprocating motion of the piston is provided in the third housing chamber.

On the other hand, a vibration reducing mechanism is provided in the second housing chamber. The vibration reducing mechanism has a supporting member which is fixed to a casing and a counter weight which is attached to the supporting member via a plate spring. A shaft hole is provided in the counter weight, and the second intermediate shaft is inserted in the shaft hole. Also, a handle part is provided at an end part of the casing on an opposite side of an attachment part of the tip tool. The handle part is provided with a trigger. Furthermore, a grip part is attached near the attachment part of the tip tool in the casing.

In the impact tool described in the Patent Literature 1 mentioned above, an operator holds the handle part with one hand, holds the grip part with the other hand, and presses the tip tool to an object. Then, by the operation of the trigger, electric power is supplied to the electric motor, and the output shaft rotates. The torque of the output shaft is transmitted to the cylinder via the first intermediate shaft and the second intermediate shaft. The tip tool is rotated together with the cylinder.

At this point, if a drill mode is selected by the operation of the change lever, the clutch is released, the torque of the second intermediate shaft is not transmitted to the sleeve, and the second intermediate shaft and the sleeve relatively rotate. In this manner, the tip tool rotates, and striking by the striker is not carried out.

On the other hand, if a hammer drill mode is selected by the operation of the change lever, the clutch is engaged. Therefore, the torque of the second intermediate shaft is transmitted to the sleeve, and the second intermediate shaft and the sleeve integrally rotate. The rotary motion of the sleeve is converted to reciprocating motion of the piston by the motion converting mechanism. When the piston reciprocates in the cylinder, the pneumatic pressure in the pneumatic chamber is rapidly increased to generate impact force. This impact force is transmitted to the tip tool via the striker and the intermediate element.

In the impact tool described in Patent Literature 1, vibrations caused by the reciprocating motion of the piston and the striking motion of the striker are generated, and the vibrations are transmitted to the counter weight via the casing, the supporting member, and the plate spring. Then, the counter weight vibrates in the same direction and the counter direction to the reciprocating motion of the piston, and the vibrations of the casing are assumed to be reduced.

CITATION LIST

Patent Literature

PTL 1: Japanese Patent Application Laid-Open Publication No. 2007-237301

PTL 2: Japanese Patent Application Laid-Open Publication No. 2008-272897

PTL 3: Japanese Patent Application Laid-Open Publication No. 2007-237304

SUMMARY OF INVENTION

Technical Problem

Incidentally, when the striker is reciprocated in a state in which the grip part is held and the tip tool is pressed to a screw member or an object, the casing swings in an arc shape about a swing supporting point at a position different from the gravity center of the casing, in other words, vibrates. The swing supporting point is estimated to be outside of the casing.

However, in the impact tool described in Patent Literature 1, the vibration reducing mechanism linearly vibrates along the first center line. Therefore, the trajectory of the swinging motion of the casing and the trajectory of the swinging motion of the vibration reducing mechanism do not match with each other, and the vibration reducing effect thereof has been inefficient.

An object of the present invention is to provide an impact tool capable of enhancing the vibration reducing efficiency of the vibration reducing mechanism as much as possible.

Solution to Problem

The present invention is an impact tool including: a casing that supports a tip tool; a moving member that is reciprocatably provided in the casing and generates impact force to be transmitted to the tip tool; an electric motor that is provided in the casing and has an output shaft; a motion converting mechanism that is provided in the casing, converts rotary motion of the output shaft to reciprocating motion, and transmits the reciprocating motion to the moving member; and a vibration reducing mechanism that is movably provided in the casing and reduces a vibration of the casing, and the vibration reducing mechanism includes: a supporting member that is provided to be swingable in a direction of a center line of reciprocation of the moving member and is fixed to a fixing position provided on the casing; and a weight that is attached to a position of the supporting member that is closer to a free end of the supporting member than the fixing position, in a plane including the center line, a gravity center of the weight and the fixing position are disposed at mutually different locations in a radial direction of the center line, and in the plane including the center line, the fixing position is disposed on a side of a gravity center of the impact tool relative to the center line.

Advantageous Effects of Invention

According to the impact tool of the present invention, since the fixing position from which the force for reducing vibrations is transmitted to the casing when the weight vibrates is close to the gravity center of the impact tool in the perpendicular direction of the center line, the vibrations can be effectively reduced.

DESCRIPTION OF EMBODIMENTS

First Embodiment

Figure 1:
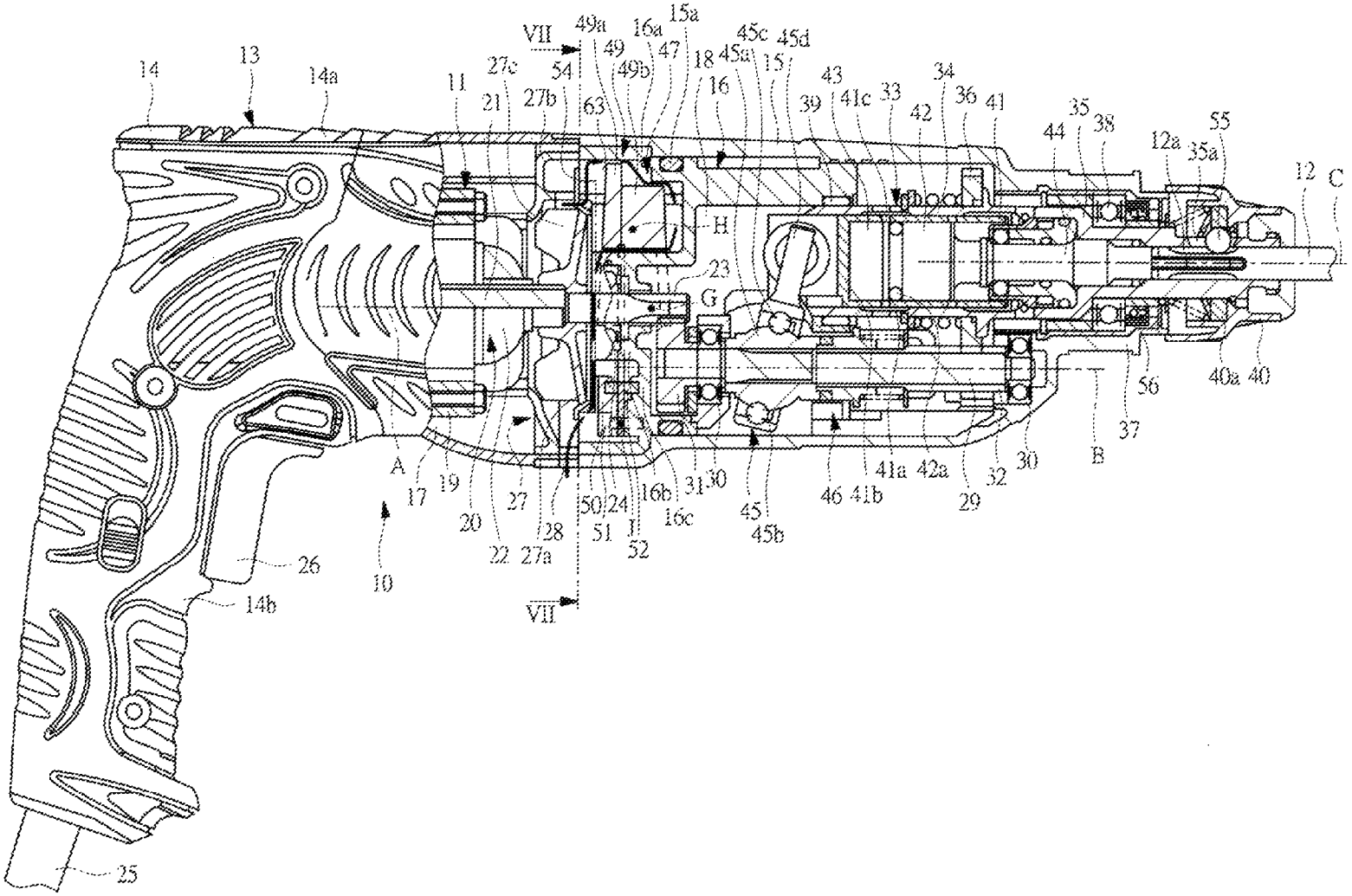
FIG. 1 is a vertical cross-sectional view showing an impact tool according to an embodiment of the present invention.
Figure 2:
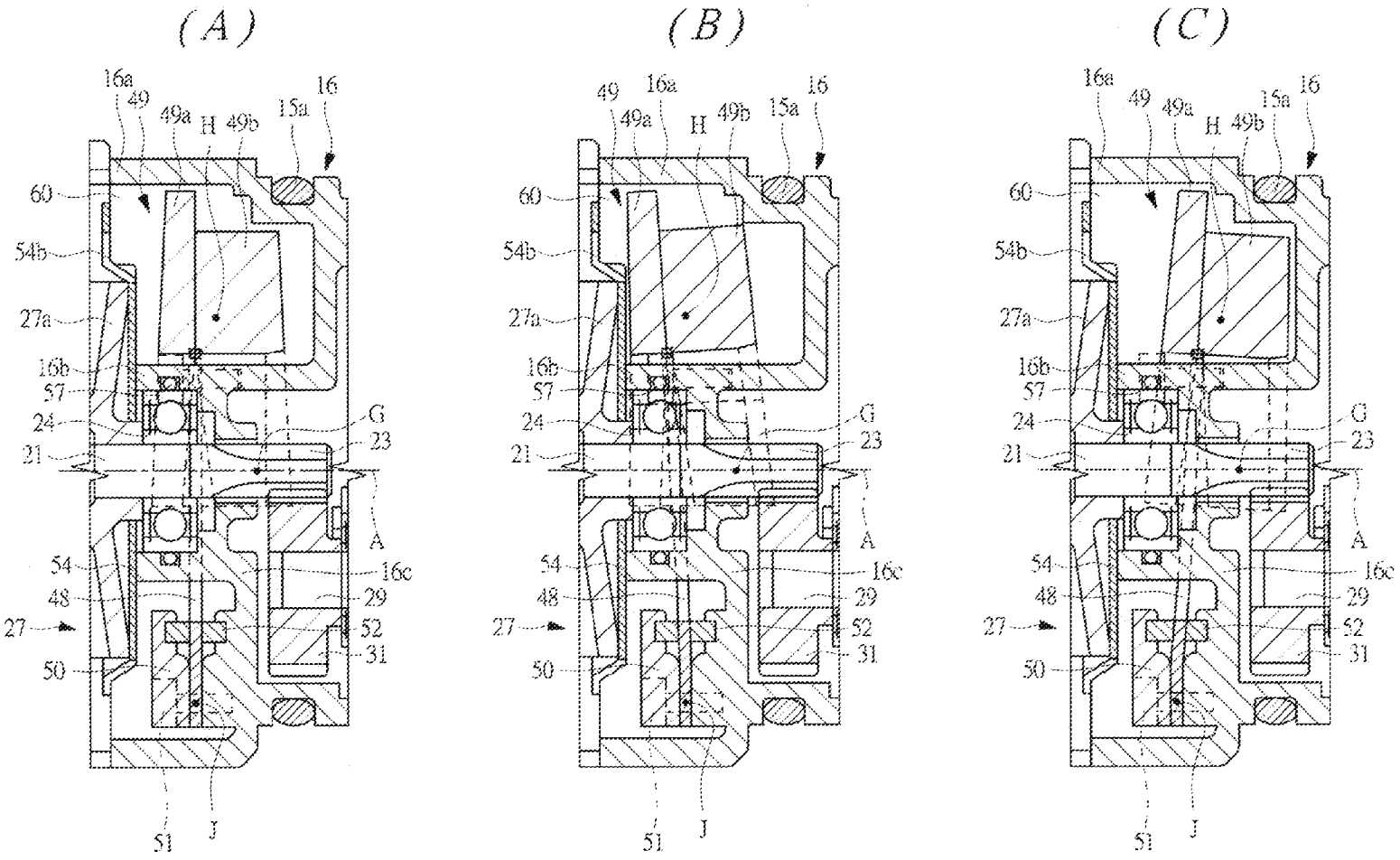
FIGS. 2(A), 2(B), and 2(C) are enlarged cross-sectional views showing a vibration reducing mechanism provided in the impact tool shown in FIG. 1.

Hereinafter, the first embodiment of the present invention will be described in detail with reference to FIG. 1 to FIG. 8. An impact tool 10 shown in FIG. 1 is a hammer drill. More specifically, the impact tool 10 has a function of transmitting power of an electric motor 11 to a tip tool 12 and rotating the tip tool 12 and a function of converting rotary motion of the electric motor 11 to impact force imparted to the tip tool 12. The impact tool 10 has a casing 13, and the casing 13 has a housing 14 and a gear cover 15. The housing 14 has a tubular body part 14*a* and a handle part 14*b* which is continuous with one end of the body part 14*a*. The handle part 14*b* is a part which is held by a hand of an operator who uses the impact tool 10. The housing 14 and the gear cover 15 are fixed by a fastening member in a state in which an open end of the body part 14*a* on the opposite side of the handle part 14*b* and one open end of the gear cover 15 are in contact with each other. The fastening member is not shown for the sake of convenience.

The gear cover 15 is formed into a tubular shape, and an inner cover 16 is provided in the gear cover 15. The inner cover 16 is made of a metal material having excellent thermal conductivity such as aluminum. The interior of the casing 13 is separated by the inner cover 16 into a first housing chamber 17 formed in the body part 14*a* and a second housing chamber 18 formed in the gear cover 15. In other words, the inner cover 16 functions as a partition wall.

The electric motor 11 is provided in the first housing chamber 17. The electric motor 11 has a stator 19 fixed to the housing 14 and a rotor 20 provided rotatably. The rotor 20 is rotatable about an axis A, and the stator 19 is disposed on an outer side of the rotor 20 in the radial direction about the axis A. The axis A is disposed in the horizontal direction in FIG. 1 for the sake of convenience. The rotor 20 has an output shaft 21 and a coil 22 attached to the output shaft 21. An output gear 23 is formed on an outer peripheral surface of the output shaft 21.

The inner cover 16 has an outer tube part 16*a* and an inner tube part 16*b* provided coaxially with the outer tube part 16*a*. The inner tube part 16*b* is provided inside the outer tube part 16*a*. An O-ring 15*a* serving as a sealing member is interposed between the outer peripheral surface of the inner cover 16 and the inner peripheral surface of the gear cover 15. Furthermore, the inner cover 16 has an overhang part 16*c* which connects an end part of the outer tube part 16*a* and an end part of the inner tube part 16*b* in the direction along the axis A. The overhang part 16*c* is extended in the radial direction about the axis A. The inner tube part 16*b* has a cylindrical shape, and a bearing 24 is attached to the inner peripheral surface of the inner tube part 16*b*. An O-ring 57 serving as a sealing member is attached between the inner peripheral surface of the inner tube part 16*b* and an outer ring of the bearing 24. The bearing 24 is a sealed bearing having a sealing member attached between the inner ring and the outer ring.

Moreover, a bearing is provided at a location which is in the first housing chamber 17 and near the handle part 14*b*. This bearing and the bearing 24 are disposed coaxially with each other, and the output shaft 21 is supported by the two bearings to be rotatable about the axis A. In this manner, the two bearings are disposed at two different locations in the direction along the axis A. One end of the output shaft 21 is disposed in the second housing chamber 18, and the output gear 23 is provided at a part of the output shaft 21 disposed in the second housing chamber 18.

Moreover, in the first housing chamber 17, a brush which supplies power to the coil 22 is provided. A power-supply cord 25 is attached to the handle part 14*b*, and the power-supply cord 25 is connected to an external power supply. A trigger 26 is provided at the handle part 14*b*, and a control circuit is provided in the handle part 14*b*. This control circuit carries out control and others for supplying the electric power, which is supplied through the power-supply cord 25, to the brush. When the trigger 26 is operated, the electric motor 11 distributes electric power to the coil 22 through the power-supply cord 25, so that a rotating magnetic field is formed between the rotor 20 and the stator 19 and the rotor 20 is rotated.

Figure 3:
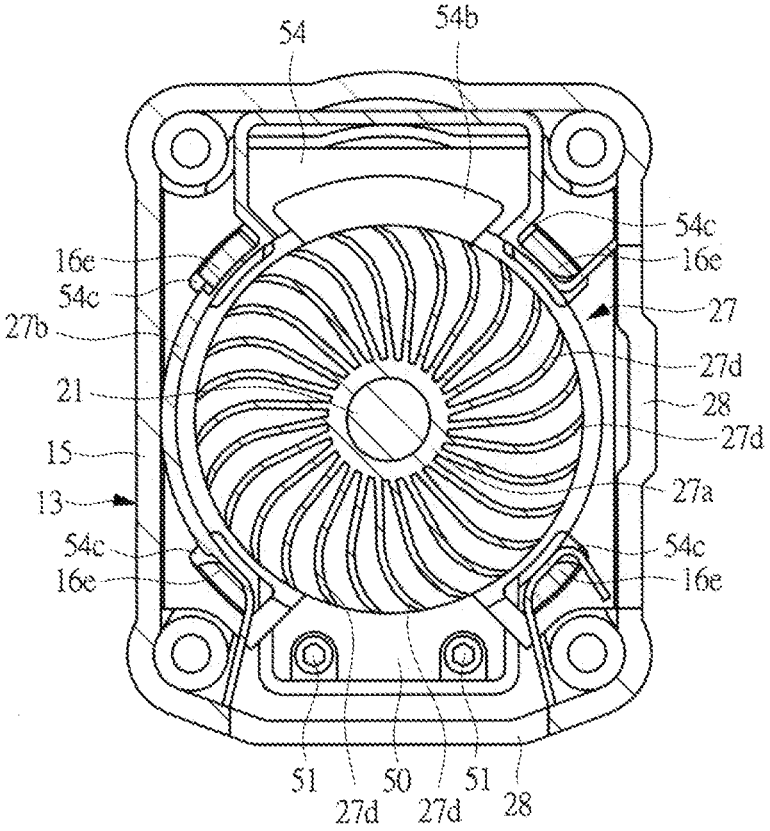
FIG. 3 is a cross-sectional view showing a configuration of a fan provided in the impact tool shown in FIG. 1.

A fan 27 is provided in the first housing chamber 17 and between the coil 22 and the inner cover 16 in the direction along the axis A. The fan 27 is a mechanism for forming flows of air which cools the electric motor 11 and the interior of the second housing chamber 18, and the fan 27 of the present embodiment is made up of a centrifugal fan. As shown in FIG. 3, the fan 27 has a bladed wheel 27*a* attached to the output shaft 21 and a guiding wall 27*b* surrounding the outer peripheral side of the bladed wheel 27*a*. The bladed wheel 27*a* is configured to rotate integrally with the output shaft 21, and the bladed wheel 27*a* has a plurality of blades 27*d* extended from the inner side toward the outer side in the radial direction about the axis A.

The guiding wall 27*b* is provided so as to surround the periphery of the bladed wheel 27*a* within a range of a predetermined angle. The guiding wall 27*b* is provided between the stator 19 and the inner cover 16 in the direction along the axis A. The guiding wall 27*b* is fixed so as not to rotate with respect to the housing 14. The fan 27 has an air intake passage 27*c* formed between the bladed wheel 27*a* and the guiding wall 27*b*. The air intake passage 27*c* is formed from the inner side toward the outer side in the radial direction about the axis A.

Figure 4:
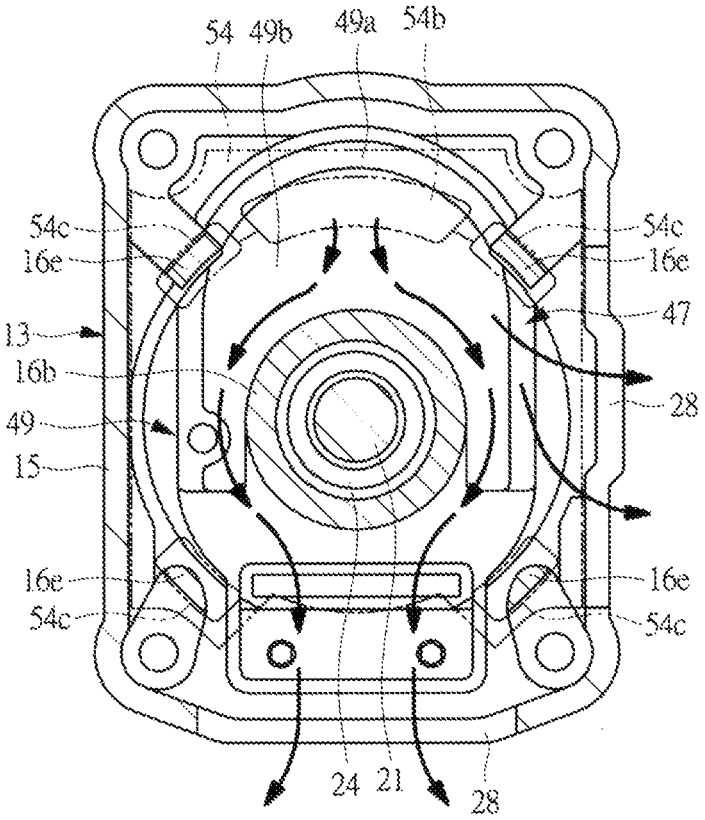
FIG. 4 is a cross-sectional view showing the flows of air discharged from the inside to the outside of a casing of the impact tool shown in FIG. 1.

As shown in FIG. 3 and FIG. 4, air holes 28 which mutually communicate the interior and the exterior of the casing 13 are provided on the outer peripheral side of the bladed wheel 27*a*, for example, at a coupling part of the housing 14 and the gear cover 15. The air holes 28 are provided for discharging the air guided by the fan 27 to the outside of the casing 13. The air holes 28 are provided at two locations, that is, on the lateral side and the lower side of the casing 13. The guiding wall 27*b* has openings at two locations opposed to the air holes 28 in the circumferential direction about the axis A.

An intermediate shaft 29 is provided in the second housing chamber 18. The intermediate shaft 29 is a power transmitting element which transmits the power of the output shaft 21 to the tip tool 12. Two bearings 30 are coaxially provided in the second housing chamber 18, and the intermediate shaft 29 is supported by the two bearings 30 to be rotatable about a center line B. The two bearings 30 are attached to the gear cover 15. The center line B is parallel to the axis A, and the center line B is disposed to be non-coaxial with the axis A. A gear 31 is provided at an end part of the intermediate shaft 29 close to the overhang part 16*c*. The gear 31 meshes with the output gear 23. A gear 32 is formed at a part of the intermediate shaft 29 between the two bearings 30.

Furthermore, a cylinder 33 is provided in the second housing chamber 18. The cylinder 33 is an element which transmits torque of the intermediate shaft 29 to the tip tool 12. The cylinder 33 has a large-diameter cylindrical part 34 and a small-diameter cylindrical part 35, which are coaxially provided about a center line C. The inner diameter of the large-diameter cylindrical part 34 is larger than the inner diameter of the small-diameter cylindrical part 35. A gear 36 is attached to the outer peripheral surface of the large-diameter cylindrical part 34. The gear 36 is provided so as to integrally rotate with the cylinder 33, and the gear 36 meshes with the gear 32. The gear 32 and the gear 36 are elements which transmit the torque of the intermediate shaft 29 to the cylinder 33.

The above-described gear cover 15 has a cylindrical part 37 at a location on the opposite side of the housing 14 in the direction along the axis A. The inner diameter of the cylindrical part 37 is larger than the outer diameter of the large-diameter cylindrical part 34 and the outer diameter of the small-diameter cylindrical part 35. A grip part is attached to the outer peripheral surface of the cylindrical part 37, and a bearing 38 is attached to the inner peripheral surface of the cylindrical part 37. A bearing 39 is attached to the inner peripheral surface of the inner cover 16. The two bearings 38 and 39 are coaxially disposed, and the large-diameter cylindrical part 34 is rotatably supported by the bearing 39. The small-diameter cylindrical part 35 is rotatably supported by the bearing 38. Thus, the cylinder 33 can be rotated about the center line C by the two bearings 38 and 39. The center line C is parallel to the axis A and the center line B, and the center line C is non-coaxial with the axis A and the center line B.

FIG. 1 mentioned above is a vertical cross-sectional view including the center line C. In FIG. 1, the axis A is positioned below the center line C, and the center line B is positioned below the axis A. All of the first center line, the second center line, and the third center line are mutually parallel. All of the first center line, the second center line, and the third center line may be positioned on the same plane, or only two center lines may be positioned on the same plane.

The cylinder 33 is positioned and fixed in the direction along the center line C with respect to the gear cover 15. Furthermore, a sealing member 56 is provided between the cylindrical part 37 and the small-diameter cylindrical part 35. The sealing member 56 is made up of, for example, a publicly known oil seal, and the sealing member 56 is provided for preventing lubrication oil sealed in the second housing chamber 18 from being leaked to the outside of the casing 13.

A tip part of the above-described small-diameter cylindrical part 35 is exposed to the outside of the cylindrical part 37. The tip tool 12 is inserted in the small-diameter cylindrical part 35. A groove 12*a* having a length in the direction along the center line C is provided in the outer peripheral surface of the tip tool 12. On the other hand, a retaining hole 35*a* penetrating through the small-diameter cylindrical part 35 in the radial direction is provided, and a ball 55 is disposed in the retaining hole 35*a*. An end cover 40 is attached to a part of the small-diameter cylindrical part 35 which is exposed to the outside of the cylindrical part 37.

The end cover 40 is configured so as to integrally rotate with the cylinder 33, and has a holding member 40*a* which prevents the ball 55 from falling from the retaining hole 35*a*. Part of the ball 55 retained in the retaining hole 35*a* is disposed in the groove 12*a*. Thus, the ball 55 can roll in the groove 12*a*. Relative rotations of the cylinder 33 and the tip tool 12 are prevented by the engaging force of the ball 55. Thus, the torque of the cylinder 33 is transmitted to the tip tool 12 via the ball 55, and the tip tool 12 is rotated.

The tip tool 12 can be moved in the direction along the center line C with respect to the cylinder 33 based on the length of the groove 12*a* in the direction along the center line C. The end cover 40 is configured so as to be attachable and detachable to/from the cylinder 33. Then, the ball 55 gets out of the retaining hole 35*a* by the operation of the end cover 40, so that the tip tool 12 can be replaced.

A piston 41 is inserted in the above-described large-diameter cylindrical part 34. The piston 41 is reciprocable in the direction along the center line C in the large-diameter cylindrical part 34. The piston 41 has a cylindrical part 41*a* and a bottom part 41*b* formed to be continuous with the cylindrical part 41*a*. An open part of the cylindrical part 41*a* is disposed on the small-diameter cylindrical part 35 side. An air hole 41*c* penetrating in the radial direction is provided in the cylindrical part 41*a*, and a striker 42 is inserted in the cylindrical part 41*a*. The striker 42 is movable in the direction along the center line C with respect to the piston 41, and a pneumatic chamber 43 is formed between the striker 42 and the bottom part 41*b* in the cylindrical part 41*a*. The volume of the pneumatic chamber 43 is set so that the impact force generated by the reciprocating motion of the piston 41 reaches a target value. An O-ring 42*a* is attached to the outer peripheral surface of the striker 42, and the O-ring 42*a* maintains the air tightness between the striker 42 and the large-diameter cylindrical part 34.

In the cylinder 33, an intermediate element 44 is provided between the striker 42 and the tip tool 12. In other words, the intermediate element 44 is disposed between the striker 42 and the tip tool 12 in the direction along the center line C, and the intermediate element 44 is movable in the direction along the center line C with respect to the cylinder 33. The intermediate element 44 is an element which transmits the impact force, which has been applied to the striker 42 as a result of the pressure increase in the pneumatic chamber 43, to the tip tool 12. The intermediate element 44 can be in contact or non-contact with the striker 42 and the tip tool 12.

On the other hand, in the second housing chamber 18, a motion converting mechanism 45 which converts the rotary motion of the intermediate shaft 29 to reciprocating motion of the piston 41 is provided. The motion converting mechanism 45 has an inner ring 45*a* and an outer ring 45*b*. The inner ring 45*a* is attached to the outer peripheral surface of the intermediate shaft 29. The inner ring 45*a* is relatively rotatable with the intermediate shaft 29. The outer peripheral surface of the inner ring 45*a* has an arc shape as the cross-sectional shape thereof in a plane including the center line B, and a groove is formed in the outer peripheral surface of the inner ring 45*a*. In accordance with the phase variation of the inner ring 45*a* in the circumferential direction, the position of the groove in the direction along the center line B is varied. A plurality of rolling elements 45*c* are interposed between the outer ring 45*b* and the inner ring 45*a* in a circumferential direction. The rolling elements 45*c* can roll along the groove. A coupling rod 45*d* is provided at the outer ring 45*b*, and the coupling rod 45*d* is coupled to the piston 41. Therefore, the outer ring 45*b* is not rotated about the center line B.

Furthermore, a clutch 46 is provided in the second housing chamber 18. The clutch 46 is a mechanism for connecting and disconnecting a power transmitting path between the inner ring 45*a* and the intermediate shaft 29. The clutch 46 integrally rotates with the intermediate shaft 29 and is movable in the direction along the center line B with respect to the intermediate shaft 29. When the clutch 46 is moved to the left side along the center line B and stopped, the power transmitting path between the intermediate shaft 29 and the inner ring 45*a* is connected. In other words, the clutch 46 is brought into an engaged state. On the other hand, when the clutch 46 is moved to the right side along the center line B and stopped, the power transmitting path between the intermediate shaft 29 and the inner ring 45*a* is disconnected. In other words, the clutch 46 is brought into a released state. Note that the move of the clutch 46 in the direction along the center line B, the stop thereof, and the direction of the move are switched when the operator operates a mode selector switch. The mode selector switch is provided on the outer surface of the casing 13, but is not shown for the sake of convenience.

When the intermediate shaft 29 rotates in the state in which the clutch 46 is engaged, the rolling elements 45*c* roll along the groove, and the outer ring 45*b* swings about a center point on the center line B within a range of a predetermined angle. Note that the center point is not shown for the sake of convenience. When the outer ring 45*b* swings within a range of a predetermined angle, the piston 41 reciprocates in the direction along the center line C.

Working of the impact tool 10 configured in the above-described manner will be described. First, the operator holds the handle part 14*b* with one hand, holds the grip part with the other hand, presses the tip tool 12 to an object, and pulls the trigger 26. Then, electric power is supplied to the electric motor 11, the rotor 20 rotates, and the torque of the output shaft 21 is transmitted to the intermediate shaft 29 via the output gear 23 and the gear 31. The torque of the intermediate shaft 29 is transmitted to the cylinder 33 via the gear 32 and the gear 36. The torque of the cylinder 33 is transmitted to the tip tool 12 via the ball 55.

When the mode selector switch is operated to select a driver mode during the working described above, the clutch 46 is brought into the released state. Therefore, the rotary motion of the intermediate shaft 29 is not converted to reciprocating motion of the piston 41. Therefore, impact force is not applied to the tip tool 12. On the other hand, when the mode selector switch is operated to select a hammer driver mode, the clutch 46 is brought into the engaged state. Therefore, the rotary motion of the intermediate shaft 29 is converted to the reciprocating motion of the piston 41. When a seal member of the striker 42 is positioned on the tip tool 12 side relative to the air hole 41*c*, the pneumatic chamber 43 is communicated with the outside of the piston 41 via the air hole 41*c*. When the tip tool 12 is pressed to a material to be ground, the striker 42 is moved to the left side in FIG. 1. As a result, the air hole 41*c* is closed by the striker 42. Then, when the piston 41 is moved rightward in FIG. 1, the pressure in the pneumatic chamber 43 is increased, and impact force is generated. The generated impact force is transmitted to the tip tool 12 via the striker 42 and the intermediate element 44. Therefore, the tip tool 12 is struck while being rotated. When the striker 42 is moved to the right side in FIG. 1, the air hole 41*c* is opened, and the pneumatic chamber 43 is communicated with the atmospheric air to reduce the pressure thereof. Therefore, the impact force is reduced, and the striker 42 is stopped. Thereafter, the above-described working is repeated along with the reciprocating motion of the piston 41.

Figure 5:
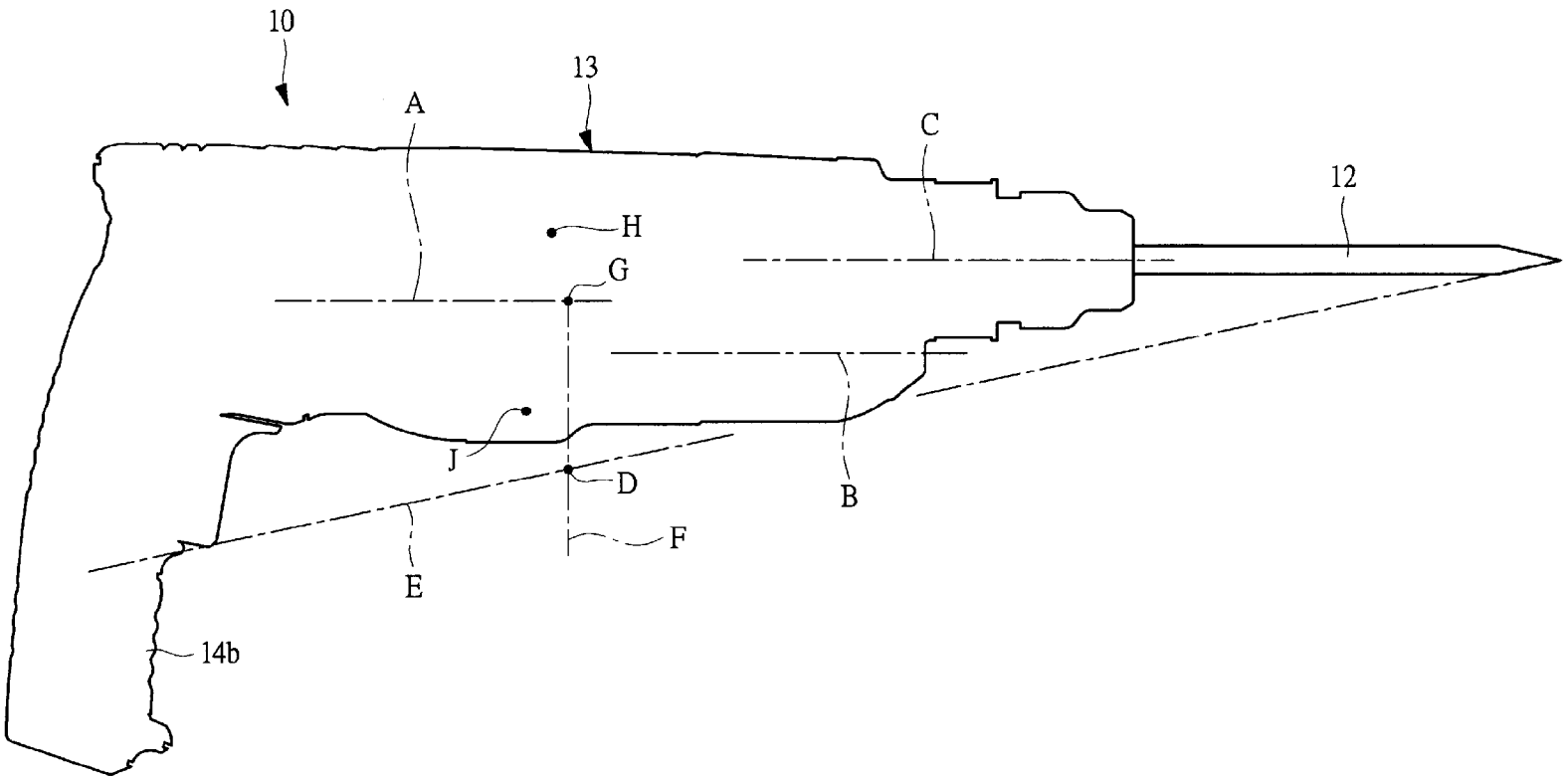
FIG. 5 is an explanatory diagram of a vibration system in the impact tool shown in FIG. 1.
Figure 6:
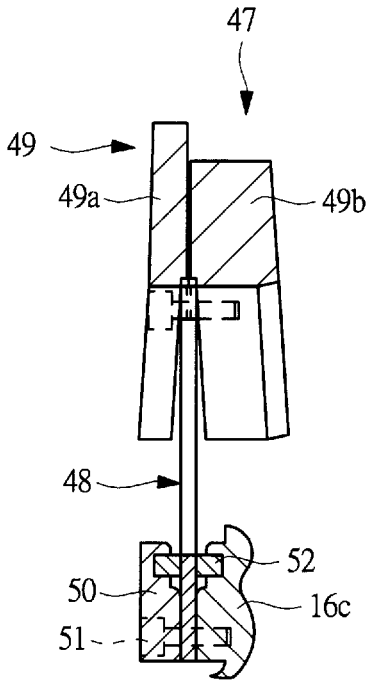
FIG. 6 is a cross-sectional view showing a main part of the vibration reducing mechanism shown in FIG. 2.

Incidentally, when the piston 41 repeats the reciprocating motion, vibrations in the direction along the center line C are generated due to the reaction force at the time of generating the impact force, working of the piston 41, and others. The vibrations are transmitted to the casing 13 via the cylinder 33 and the bearings 38 and 39 or transmitted to the casing 13 via the motion converting mechanism 45, the intermediate shaft 29, and the bearing 30. As a result, the casing 13 is vibrated. An example of the vibrated state of the casing 13 will be described based on FIG. 5. FIG. 5 schematically shows the impact tool 10 by the plane including the center lines B and C and the axis A. For example, the casing 13 vibrates in an arc-shaped trajectory about a swinging center D within a range of a predetermined angle, that is, swings. The swinging center D is an intersection point of a first line segment E and a second line segment F. The first line segment E passes through the tip of the tip tool 12 and the center point of the handle part 14*b* in a longitudinal direction. The second line segment F passes through the gravity center G of the casing 13 and is orthogonal to the axis A. In FIG. 5, the gravity center G of the casing 13 is shown on the axis A.

The impact tool 10 of the present embodiment has a vibration reducing mechanism 47 which reduces the vibrations of the casing 13. The configuration of the vibration reducing mechanism 47 will be described based on FIG. 1, FIG. 2, FIG. 5, FIG. 6, and FIG. 7. The vibration reducing mechanism 47 has a supporting member 48 which is attached to the overhang part 16*c* and a weight 49 which is supported by the supporting member 48. The supporting member 48 is integrally formed of a metal material. The supporting member 48 has a base part 48*a* and two arm parts 48*b* branched from the base part 48*a*. The opposing parts of the two arm parts 48*b* are formed to have arc shapes. The base part 48*a* is sandwiched by the overhang part 16*c* and a mount member 50 and is fixed to the overhang part 16*c* by screws 51. The supporting member 48 may be made of a metal material having spring elasticity. The fixing position J at which the supporting member 48 is fixed by the screws 51 is positioned below the center line B. Furthermore, a rubber member 52 is attached to the base part 48*a* of the supporting member 48. In this manner, the supporting member 48 is attached in a cantilever fashion with respect to the inner cover 16 and can swing with using the fixing position J as a supporting point.

The above-described weight 49 is attached to a position that is closer to a free end of the supporting member 48 than the fixing position J thereof, that is, to the two arm parts 48*b*. The weight 49 is made of, for example, a metal material. The weight 49 has a C-shape in the plane perpendicular to the axis A, and the inner peripheral surface of the weight 49 is formed to have an arc shape. The weight 49 has two constituent pieces 49*a* and 49*b* attached so as to sandwich the two arm parts 48*b*. In the direction along the axis A, the constituent piece 49*b* is disposed at a position close to the overhang part 16*c* compared with the constituent piece 49*a*. Also, in the direction along the first center line, the constituent piece 49*b* is thicker than the constituent piece 49*a*. Therefore, in the entire weight 49, the width in the direction along the axis A from the supporting member 48 serving as a center is larger in the constituent piece 49*b* which is positioned on the opposite side of the electric motor 11 than in the constituent piece 49*a*. The opposite side of the electric motor 11 means the motion converting mechanism 45 side.

In FIG. 5, the gravity center H of the weight 49 is disposed above the center line C. In this manner, in the plane including the center lines B and C, the gravity center G is disposed between the fixing position J and the gravity center H, and the center line C is disposed between the gravity center H and the gravity center G. The vibrated state of the casing 13 shown in FIG. 5 merely shows just one analyzed example. For example, the gravity center H and the fixing position J are only required to be disposed at positions mutually different in the radial direction about the center line C. Also, the gravity center G and the fixing position J may be disposed at mutually different positions on a straight line parallel to the center line C. Furthermore, the gravity center H may be disposed on the center line C. "On the center line C" includes "on the extended line of the center line C".

Between the weight 49 and the two arm parts 48*b*, a shaft hole 53 is provided in the plane perpendicular to the axis A. The inner tube part 16*b* is disposed in the shaft hole 53. More specifically, the vibration reducing mechanism 47 is provided so as to surround the inner tube part 16*b* in the plane perpendicular to the axis A.

The natural vibration frequency of the vibration reducing mechanism 47 is set to be equal to the striking frequency in a boring operation. The natural vibration frequency of the vibration reducing mechanism 47 is determined by such conditions as the mass of the weight 49, the rigidity of the supporting member 48, and the length from the fixing position of the supporting member 48 to the gravity center H of the weight 49. If the supporting member 48 has spring elasticity, the spring constant of the supporting member 48 is a factor to determine the natural vibration frequency. The inner diameter of the shaft hole 53 is set to a value with which the vibration reducing mechanism 47 and the inner tube part 16*b* are not brought into contact with each other when the supporting member 48 and the weight 49 swing.

The vibration reducing mechanism 47 having the above-described configuration is movable about the swinging center D of the casing 13. Specifically, the supporting member 48 is elastically deformed with using the fixing position J as a supporting point and vibrates in the directions opposite to the directions of the vibrations of the casing 13, thereby reducing and absorbing the vibrations of the casing 13. The opposite directions can be translated into opposite phases in other words. When the supporting member 48 and the weight 49 vibrate, the rubber member 52 is elastically deformed so as to be crushed by the mount member 50 and the supporting member 48, thereby absorbing the vibrations.

Furthermore, the vibration reducing mechanism 47 and the fan 27 are disposed to be arranged in the direction along the axis A. Therefore, if the amplitude of vibrations is large when the supporting member 48 and the weight 49 vibrate, the weight 49 may contact the fan 27, specifically, the bladed wheel 27*a*. For this reason, in the first housing chamber 17, a plate 54 which prevents the weight 49 from contacting the bladed wheel 27*a* is provided. The plate 54 is integrally formed of a metal plate, and the plate 54 is fixed to the casing 13. The plate 54 has a shaft hole 54*a* penetrating therethrough in the direction along the axis A, and the output shaft 21 and a boss part of the bladed wheel 27*a* are inserted in the shaft hole 54*a*. An inner peripheral end of the plate 54 is disposed between the fan 27 and the inner tube part 16*b* in the direction along the axis A. A housing chamber 63 is provided in the space surrounded by the plate 54 and the inner cover 16 in the direction along the axis A. The vibration reducing mechanism 47 is disposed in the housing chamber 63.

Moreover, in the plate 54, an air hole 54*b* is provided at a location corresponding to an outer peripheral end of the bladed wheel 27*a*. The air hole 54*b* is provided to have the shape of an arc about the axis A. The air hole 54*b* is a path which guides the flow of air, which has been formed by the rotation of the bladed wheel 27*a*, toward the inner cover 16. Moreover, the plate 54 is provided with a plurality of attachment holes 54*c* which penetrate therethrough in the thickness direction.

On the other hand, the inner cover 16 is provided with a plurality of latching claws 16*e*, and the latching claws 16*e* are inserted in the attachment holes 54*c*. By virtue of this structure, the plate 54 is positioned and fixed with respect to the casing 13 in the circumferential direction about the axis A. In the above-described embodiment, the bearings 24, 30, and 38 have a function of receiving both of thrust load and radial load.

On the other hand, a lubricated part is provided in the second housing chamber 18. The lubricated part includes meshed parts of the output gear 23 and the gear 31, meshed parts of the gear 32 and the gear 36, the motion converting mechanism 45, and contact parts of the piston 41 and the cylinder 33. The lubrication oil which lubricates and cools the lubricated part is sealed in the second housing chamber 18. The sealing member 56 prevents the lubrication oil in the second housing chamber 18 from being leaked to the outside of the casing 13 via the space between the small-diameter cylindrical part 35 and the cylindrical part 37. The O-ring 15*a* prevents the lubrication oil in the second housing chamber 18 from being leaked to the first housing chamber 17 via the space between the inner cover 16 and the gear cover 15. Furthermore, the sealing member attached to the bearing 24 prevents the lubrication oil in the second housing chamber 18 from being leaked to the first housing chamber 17.

In the present embodiment, the fixing position J of the supporting member 48 is below the center line B as shown in FIG. 5. The supporting member 48 and the weight 49 vibrate with using the fixing position J as a supporting point, and the vibration trajectory of the weight 49 has an arch shape. More specifically, when the casing 13 vibrates in the arc shape about the swinging center D, the vibration trajectory of the casing 13 and the vibration trajectory of the weight 49 can be caused to approximate each other as much as possible, and vibration reducing efficiency is improved. The center line C and the gravity center H of the weight 49 are set to be as close as possible in the radial direction about the center line C. Therefore, the vibration reducing mechanism 47 can effectively vibrate the weight, and the vibration reducing effect is improved.

Furthermore, the disposed positions of the bearing 24 and the weight 49 in the direction along the axis A are at least partially overlapped with each other. The vibration reducing mechanism 47 is disposed on an outer side of the output gear 23 in the radial direction about the axis A. Furthermore, the disposed positions of the vibration reducing mechanism 47 and the output gear 23 in the direction along the axis A are partially overlapped with each other. The axis A and the center line C are parallel to each other. Therefore, the disposing space of the bearing 24 and the vibration reducing mechanism 47 can be shortened as much as possible in the direction along the center line C. Therefore, increase in the size of the impact tool 10 can be suppressed.

The vibration reducing mechanism 47 is disposed on an outer side of the inner tube part 16*b* in the radial direction about the axis A, and the output gear 23 is disposed on an inner side of the inner tube part 16*b*. Therefore, the length of the output shaft 21 from the part supported by the bearing 24 to the end part including the part at which the output gear 23 is formed can be shortened as much as possible. Therefore, the output shaft 21 can be supported by the single bearing 24 on the output gear 23 side, and the number of parts can be reduced.

Moreover, since the output shaft 21 is inserted in the shaft hole 53 of the vibration reducing mechanism 47, the disposing space of parts in the direction along the axis A can be narrowed. Moreover, even when the vibration reducing mechanism 47 vibrates, contact with the output shaft 21 can be avoided. Furthermore, even when the vibration reducing mechanism 47 vibrates, contact with the cylindrical part 16*d* can be avoided.

The fan 27 in the present embodiment is rotated by the torque of the rotor 20 of the electric motor 11 and takes in the air in the first housing chamber 17. In the first housing chamber 17, a flow of air is formed by the rotation of the fan 27. The electric motor 11 exchanges heat with the flowing air, and temperature increase of the electric motor 11 is suppressed. The air of the first housing chamber 17 passes through the air intake passage 27*c* and is guided toward outside in the radial direction. The guided air passes through the air hole 54*b* of the plate 54 and flows into the space between the plate 54 and the inner cover 16. The air which has flown into the space between the plate 54 and the inner cover 16 flows along the surface of the overhang part 16*c* of the inner cover 16 and then flows along the surface of the inner tube part 16*b* in the shaft hole 53.

The heat in the second housing chamber 18 is transmitted to the inner cover 16. The heat transmitted to the inner cover 16 is transmitted to the air flowing along the inner cover 16, and the temperature of the air is increased. The air whose temperature has been increased passes through the air hole 28 and is discharged to the outside of the casing 13. In this manner, temperature increase in the second housing chamber 18 is suppressed.

Therefore, leakage of the lubrication oil to the outside of the casing 13 or leakage of the lubrication oil in the second housing chamber 18 to the first housing chamber 17 caused by reduction in the viscosity of the lubrication oil sealed in the second housing chamber 18 can be prevented. Moreover, the change or deterioration of the characteristics of the rubber member 52 attached to the supporting member 48 can be prevented. Furthermore, deviation of the impact force from a target value caused by change in the pneumatic pressure of the pneumatic chamber 43 due to temperature increase in the second housing chamber 18 can be prevented.

Since the constituent piece 49*b* is wider than the constituent piece 49*a*, the bearing 24 can be disposed to be close to the electric motor 11 without reducing the vibration reducing effect. Particularly, when the fan 27 is provided between the bearing 24 and the electric motor 11, the fan 27 and the bearing 24 can be disposed to be close to each other as much as possible in the direction along the axis A. Furthermore, since the weight 49 is disposed on the opposite side of the intermediate shaft 29 with the output shaft 21 interposed therebetween, when the weight 49 vibrates, the weight 49 can be prevented from interfering with the intermediate shaft 29.

Also, since the fixing position J at which the force for reducing the vibrations is transmitted to the casing 13 when the weight 49 vibrates is close to the gravity center G of the impact tool 10 in the direction along the center line C, vibrations can be effectively reduced. Furthermore, the fixing position J is away from the center line C compared with the gravity center G of the impact tool 10 in the direction along the center line C, and the distance from the fixing position J to the weight 49 is made long in the radial direction about the axis A; therefore, the quantity of the vibrations of the weight 49 can be increased.

Furthermore, the axis A of the output shaft 21 is disposed to be parallel to and non-coaxial with the center line C. Therefore, the size of the impact tool 10 in the direction along the center line C can be reduced, the gravity center G of the impact tool 10 and the fixing position J of the weight 49 can be caused to be close to each other in the direction along the center line C, and generation of rotation moment due to the vibrations of the weight 49 can be suppressed.

Next, another configuration example of the weight 49 of the impact tool 10 will be described based on FIG. 9. The constituent piece 49*a* is provided with a hole 49*c*, and the constituent piece 49*b* is provided with a hole 49*d*. The hole 49*c* is penetrating through the constituent piece 49*a* in the direction along the axis A. The hole 49*d* is penetrating through the constituent piece 49*b* in the direction along the axis A. In the plane perpendicular to the axis A, the holes 49*c* and 49*d* are disposed on the same circumference and are disposed in the same phase. In other words, the hole 49*c* and the hole 49*d* are connected to each other. The impact tool 10 shown in FIG. 9 has the same configuration as the impact tool 10 shown in FIG. 1 except for that of the weight 49.

Figure 9:
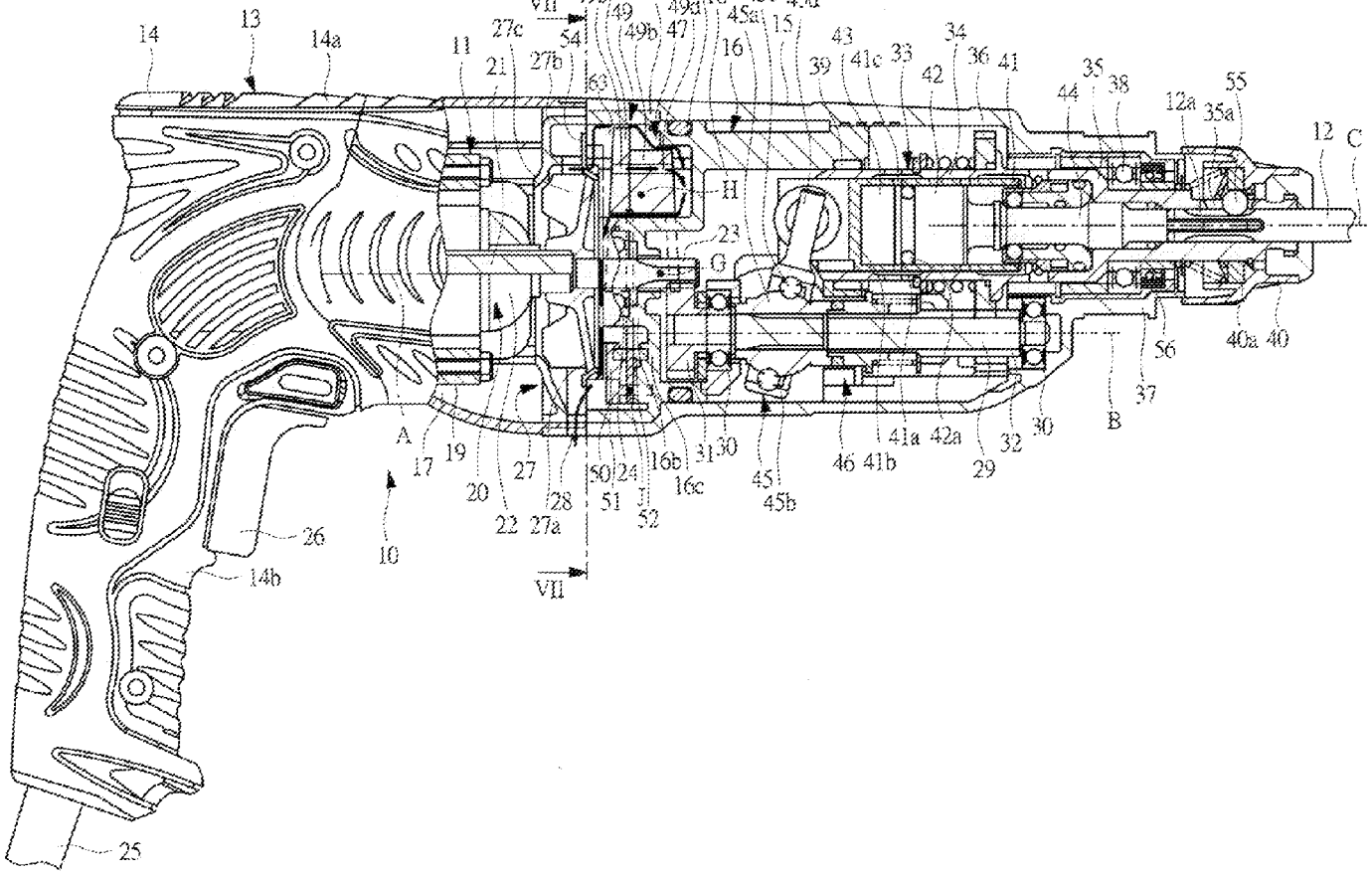
FIG. 9 is a vertical cross-sectional view showing another specific example of the vibration reducing mechanism in the impact tool according to the embodiment of the present invention.

In the impact tool 10 shown in FIG. 9, part of the air sucked in by the fan 27 passes through the holes 49*c* and 49*d* of the weight 49 and is directed to the overhang part 16*c*. More specifically, the holes 49*c* and 49*d* of the weight 49 have a function of making the air flow smooth.

The present invention is not limited to the embodiment described above, and it goes without saying that various modifications can be made within a range not departing from the gist thereof. For example, in the above-described embodiment, the impact tool is only required to be able to apply impact force to the tip tool, and the impact tool may be configured to be unable to rotate the tip tool. Also, the impact tool may be configured to be able to select the three modes of a hammer only mode, a drill only mode, and a hammer drill mode. The hammer only mode is a mode in which only impact force is applied to the tip tool, the drill only mode is a mode in which only rotative force is applied to the tip tool, and the hammer drill mode is a mode in which impact force and rotative force are applied to the tip tool. The tip tool may be a driver bit for fastening screw members. Furthermore, the tip tool may be a drill bit for boring or chipping concrete, stone materials, and others.

Furthermore, the fan provided in the casing may be an axial flow fan. Examples of the air guiding path provided in the weight include notches and grooves other than holes. Furthermore, the impact tool can be used in any of the states including the state in which the two center lines and the axis are along the perpendicular direction, the state in which they are along the horizontal direction, and the state in which they are along a direction between the horizontal direction and the perpendicular direction. Furthermore, the gravity center of the impact tool can be used as a criterion of analysis of the vibrations of the casing instead of the gravity center of the casing. The gravity center of the impact tool is the center of the total mass of the mass of the casing and the mass of the parts, mechanisms, elements, and others provided in the casing. Still furthermore, the impact tool may have a structure in which a battery which supplies electric power to the electric motor is housed in the casing or a structure in which a battery with a cassette structure is attached to the casing. The hole provided in the vibration reducing mechanism 47 may be a recessed part.

Since all of the axis A and the center lines B and C are mutually parallel, the direction along the axis A is the same as the direction along the center line B or the center line C, the direction along the center line B is the same as the direction along the center line C or the axis A, and the direction along the center line C is the same as the direction along the center line B or the axis A.

Herein, the correspondence relation between the configuration described in the first embodiment and the configuration of the present invention will be described. The piston 41 corresponds to a moving member of the present invention, the center line C corresponds to a center line of the present invention, the gravity center G corresponds to the gravity center of the casing of the present invention, the gravity center H corresponds to the gravity center of the weight of the present invention, the output gear 23 corresponds to a first gear of the present invention, the intermediate shaft 29 corresponds to a power transmitting shaft of the present invention, the gear 31 corresponds to a second gear of the present invention, and the shaft hole 53 corresponds to a hole in the present invention.

Second Embodiment

Next, the second embodiment of the present invention will be described.

The present invention relates to an impact tool capable of applying an impact force to a tip tool like a hammer drill, a hammer driver, or others.

Conventionally, an impact tool such as a hammer drill or a hammer driver is capable of applying an impact force to a tip tool. Such an impact tool has: a casing; a tip tool which is rotated by an electric motor provided in the casing; a striker which is provided so as to be linearly reciprocable in the casing; a motion converting mechanism which converts rotary motion of the electric motor to reciprocating motion of a piston; and a striker which transmits the impact force generated by the reciprocating motion of the piston to the tip tool. In the impact tool, the casing vibrates due to the reciprocating motion of the piston, the movement of striking the tip tool by the striker, and others. For this reason, techniques by which the vibrations of the casing in the impact tool can be reduced have been proposed, and an example thereof is described in Patent Literature 1.

An impact tool described in Patent Literature 1 has a hollow casing, and the interior of the casing is separated into a first housing chamber, a second housing chamber, and a third housing chamber by two partition walls. An electric motor is provided in the first housing chamber. The electric motor has an output shaft, and is configured so that the output shaft is rotated when electric power of an external power supply is supplied.

Bearings are attached to the two partition walls, respectively, and a first intermediate shaft is supported by the bearing to be rotatable about a first center line. The first intermediate shaft is disposed across the second housing chamber and the third housing chamber. The output shaft and the first intermediate shaft are coaxially provided, and the output shaft and the first intermediate shaft are coupled so as to be integrally rotated. A first gear is provided at a part of the first intermediate shaft which is positioned in the third housing chamber.

Also, a second intermediate shaft is provided in the third housing chamber, and the second intermediate shaft is supported by two bearings to be rotatable about a second center line. The second intermediate shaft is provided with a second gear, and the first gear and the second gear mesh with each other. Furthermore, the second intermediate shaft is provided with a gear part. Moreover, the third housing chamber is provided with a cylinder having a cylindrical shape, and in the cylinder, a piston, a striker, an intermediate element, and a tip tool are inserted to be reciprocable in a direction along a third center line (center line) of the cylinder. A pneumatic chamber is formed between the piston and the striker in the cylinder. All of the first center line, the second center line, and the third center line are mutually parallel. The tip tool is provided so as to rotate integrally with the cylinder, and a tip of the tip tool is exposed to the outside of the cylinder. A third gear is attached to the cylinder, and the third gear and the gear part mesh with each other. Furthermore, a sleeve having a cylindrical shape is attached to an outer peripheral surface of the second intermediate shaft so as to be relatively rotatable with the second intermediate shaft. In the third housing chamber, a clutch which engages and releases the sleeve and the second intermediate shaft is provided. Moreover, the clutch is configured so that actuations are switched by the operation of a change lever. Furthermore, a motion converting mechanism which converts rotary motion of the sleeve to reciprocating motion of the piston is provided in the third housing chamber.

On the other hand, a vibration reducing mechanism is provided in the second housing chamber. The vibration reducing mechanism has a supporting member which is fixed to a casing and a counter weight which is attached to the supporting member via a plate spring. A shaft hole is provided in the counter weight, and the second intermediate shaft is inserted in the shaft hole. Also, a handle part is provided at an end part of the casing on an opposite side of an attachment part of the tip tool. The handle part is provided with a trigger. Furthermore, a grip part is attached near the attachment part of the tip tool in the casing.

In the impact tool described in the Patent Literature 1 mentioned above, an operator holds the handle part with one hand, holds the grip part with the other hand, and presses the tip tool to an object. Then, by the operation of the trigger, electric power is supplied to the electric motor, and the output shaft rotates. The torque of the output shaft is transmitted to the cylinder via the first intermediate shaft and the second intermediate shaft. The tip tool is rotated together with the cylinder.

At this point, if a drill mode is selected by the operation of the change lever, the clutch is released, the torque of the second intermediate shaft is not transmitted to the sleeve, and the second intermediate shaft and the sleeve relatively rotate. In this manner, the tip tool rotates, and striking by the striker is not carried out.

On the other hand, if a hammer drill mode is selected by the operation of the change lever, the clutch is engaged. Therefore, the torque of the second intermediate shaft is transmitted to the sleeve, and the second intermediate shaft and the sleeve integrally rotate. The rotary motion of the sleeve is converted to reciprocating motion of the piston by the motion converting mechanism. When the piston reciprocates in the cylinder, the pneumatic pressure in the pneumatic chamber is rapidly increased to generate impact force. This impact force is transmitted to the tip tool via the striker and the intermediate element.

In the impact tool described in Patent Literature 1, vibrations caused by the reciprocating motion of the piston and the striking motion of the striker are generated, and the vibrations are transmitted to the counter weight via the casing, the supporting member, and the plate spring. Then, the counter weight vibrates in the same direction and the counter direction to the reciprocating motion of the piston, and the vibrations of the casing are assumed to be reduced.

However, in the impact tool described in Patent Literature 1, the two bearings are provided in the direction along the first center line. The vibration reducing mechanism is provided between the two bearings in the direction along the first center line. The first center line is parallel to the third center line. Therefore, the impact tool has a problem that the size thereof is increased in the direction along the third center line (center line) in which the striker reciprocates.

An object of the second embodiment of the present invention is to provide an impact tool capable of preventing increase in the size thereof in the direction along the center line in which a striker reciprocates. The impact tool of the second embodiment has the configurations shown in FIG. 1 to FIG. 8 describing the first embodiment and can obtain effects similar to those of the impact tool 10 of the first embodiment.

Herein, the correspondence relation between the configuration described in the second embodiment and the configuration of the present invention will be described. The piston 41 corresponds to a moving member of the present invention, the center line C corresponds to a center line of the present invention, the output gear 23 corresponds to a first gear of the present invention, the gear 32 corresponds to a second gear of the present invention, the gear 36 corresponds to a third gear of the present invention, the shaft hole 53 corresponds to a hole of the present invention, the inner tube part 16*b* corresponds to a cylindrical part of the present invention, and the intermediate shaft 29 corresponds to a power transmitting shaft of the present invention.

Third Embodiment

Next, the third embodiment will be described.

The present invention relates to an impact tool capable of applying an impact force to a tip tool like a hammer drill, a hammer driver, or others.

Conventionally, an impact tool such as a hammer drill or a hammer driver is capable of applying an impact force to a tip tool. Such an impact tool has: a casing; a tip tool which is rotated by an electric motor provided in the casing; a striker which is provided so as to be linearly reciprocable in the casing; a motion converting mechanism which converts rotary motion of the electric motor to reciprocating motion of a piston; and a striker which transmits the impact force generated by the reciprocating motion of the piston to the tip tool. In the impact tool, the casing vibrates due to the reciprocating motion of the piston, the movement of striking the tip tool by the striker, and others. For this reason, techniques by which the vibrations of the casing in the impact tool can be reduced have been proposed, and an example thereof is described in Patent Literature 1.

An impact tool described in Patent Literature 1 has a hollow casing, and the interior of the casing is separated into a first housing chamber, a second housing chamber, and a third housing chamber by two partition walls. An electric motor is provided in the first housing chamber. The electric motor has an output shaft, and is configured so that the output shaft is rotated when electric power of an external power supply is supplied.

Bearings are attached to the two partition walls, respectively, and a first intermediate shaft is supported by the bearing to be rotatable about a first center line. The first intermediate shaft is disposed across the second housing chamber and the third housing chamber. The output shaft and the first intermediate shaft are coaxially provided, and the output shaft and the first intermediate shaft are coupled so as to be integrally rotated. A first gear is provided at a part of the first intermediate shaft which is positioned in the third housing chamber.

Also, a second intermediate shaft is provided in the third housing chamber, and the second intermediate shaft is supported by two bearings to be rotatable about a second center line. The second intermediate shaft is provided with a second gear, and the first gear and the second gear mesh with each other. Furthermore, the second intermediate shaft is provided with a gear part. Moreover, the third housing chamber is provided with a cylinder having a cylindrical shape, and in the cylinder, a piston, a striker, an intermediate element, and a tip tool are inserted to be reciprocable in a direction along a third center line (center line) of the cylinder. A pneumatic chamber is formed between the piston and the striker in the cylinder. All of the first center line, the second center line, and the third center line are mutually parallel. The tip tool is provided so as to rotate integrally with the cylinder, and a tip of the tip tool is exposed to the outside of the cylinder. A third gear is attached to the cylinder, and the third gear and the gear part mesh with each other. Furthermore, a sleeve having a cylindrical shape is attached to an outer peripheral surface of the second intermediate shaft so as to be relatively rotatable with the second intermediate shaft. In the third housing chamber, a clutch which engages and releases the sleeve and the second intermediate shaft is provided. Moreover, the clutch is configured so that actuations are switched by the operation of a change lever. Furthermore, a motion converting mechanism which converts rotary motion of the sleeve to reciprocating motion of the piston is provided in the third housing chamber.

On the other hand, a vibration reducing mechanism is provided in the second housing chamber. The vibration reducing mechanism has a supporting member which is fixed to a casing and a counter weight which is attached to the supporting member via a plate spring. A shaft hole is provided in the counter weight, and the second intermediate shaft is inserted in the shaft hole. Also, a handle part is provided at an end part of the casing on an opposite side of an attachment part of the tip tool. The handle part is provided with a trigger. Furthermore, a grip part is attached near the attachment part of the tip tool in the casing.

In the impact tool described in the Patent Literature 1 mentioned above, an operator holds the handle part with one hand, holds the grip part with the other hand, and presses the tip tool to an object. Then, by the operation of the trigger, electric power is supplied to the electric motor, and the output shaft rotates. The torque of the output shaft is transmitted to the cylinder via the first intermediate shaft and the second intermediate shaft. The tip tool is rotated together with the cylinder.

At this point, if a drill mode is selected by the operation of the change lever, the clutch is released, the torque of the second intermediate shaft is not transmitted to the sleeve, and the second intermediate shaft and the sleeve relatively rotate. In this manner, the tip tool rotates, and striking by the striker is not carried out.

On the other hand, if a hammer drill mode is selected by the operation of the change lever, the clutch is engaged. Therefore, the torque of the second intermediate shaft is transmitted to the sleeve, and the second intermediate shaft and the sleeve integrally rotate. The rotary motion of the sleeve is converted to reciprocating motion of the piston by the motion converting mechanism. When the piston reciprocates in the cylinder, the pneumatic pressure in the pneumatic chamber is rapidly increased to generate impact force. This impact force is transmitted to the tip tool via the striker and the intermediate element.

In the impact tool described in Patent Literature 1, vibrations caused by the reciprocating motion of the piston and the striking motion of the striker are generated, and the vibrations are transmitted to the counter weight via the casing, the supporting member, and the plate spring. Then, the counter weight vibrates in the same direction and the counter direction to the reciprocating motion of the piston, and the vibrations of the casing are assumed to be reduced.

Moreover, a fan which rotates together with the output shaft is provided in the first housing chamber. When the electric motor is driven and the fan is rotated, the air in the first housing chamber is sucked in by the fan, and air flow is formed. Then, the heat of the electric motor is transmitted to the air, and temperature increase of the electric motor is suppressed. The air that flows in the first housing chamber flows through an air hole provided in the casing and is discharged to the outside of the casing.

However, in the impact tool described in Patent Literature 1, the first housing chamber in which the fan is provided, the second housing chamber in which the vibration reducing mechanism is provided, and the third housing chamber in which the gear, the motion converting mechanism, and others are provided are separated by the partition walls. Therefore, even when the fan is driven by the power of the electric motor and air flow is formed, the air does not flow into the second housing chamber, but is directly discharged to the outside of the casing. Therefore, the heat of cooling objects such as the vibration reducing mechanism provided in the second housing chamber, cooling objects such as the bearings attached to the partition walls, and cooling objects such as the gear and the motion converting mechanism provided in the third housing chamber is not easily transmitted to the air formed by the fan.

An object of the third embodiment of the present invention is to provide an impact tool capable of facilitating the transmission of the heat of the cooling objects, which are provided in the housing chambers other than the first housing chamber, to the air generated by the fan as much as possible when the fan is driven in the first housing chamber to form the air flow. The impact tool of the third embodiment has the configuration shown in FIG. 1 to FIG. 8 and can obtain effects similar to those of the impact tool 10 of the first embodiment.

Herein, the correspondence relation between the configuration described in the third embodiment and the configuration of the present invention will be described. The piston 41 corresponds to a moving member of the present invention, the fan 27 corresponds to a cooling fan of the present invention, the first housing chamber 17 corresponds to a first housing chamber of the present invention, the housing chamber 63 corresponds to a second housing chamber of the present invention, the inner cover 16 corresponds to a partition wall of the present invention, and the housing chamber 18 corresponds to a third housing chamber of the present invention. Also, the rubber member 52 corresponds to a cooling object and a damper of the present invention, the plate 54 corresponds to a partition wall of the present invention, and the air hole 54*b* corresponds to a passage of the present invention, and the center line C corresponds to a center line of the present invention. Furthermore, the meshed parts of the output gear 23 and the gear 31, the meshed parts of the gear 32 and the gear 36, the motion converting mechanism 45, and the contact parts of the piston 41 and the cylinder 33 correspond to lubricated parts of the present invention.

Fourth Embodiment

Next, the fourth embodiment will be described.

The present invention relates to an impact tool capable of applying an impact force to a tip tool like a hammer drill, a hammer driver, or others.

Conventionally, an impact tool such as a hammer drill or a hammer driver is capable of applying an impact force to a tip tool. Such an impact tool has: a casing; an electric motor; a motion converting mechanism; a piston; a striker; and a tip tool. The electric motor is provided in the casing, and the tip tool is rotated by the power of the electric motor. The striker is provided so as to be linearly reciprocable in the casing. The motion converting mechanism and the piston are provided in the casing, and the motion converting mechanism converts rotary motion of the electric motor to reciprocating motion of the piston. The striker transmits the impact force which is generated by the reciprocating motion of the piston to the tip tool. In the impact tool, the main body of the tool vibrates due to the reciprocating motion of the piston, the movement of striking the tip tool by the striker, and others. For this reason, techniques by which the vibrations of the main body of the tool can be reduced in the impact tool have been proposed, and an example thereof is described in Patent Literature 2.

An impact tool described in Patent Literature 2 is provided with a vibration reducing mechanism which reduces the vibrations of a casing. The vibration reducing mechanism is provided with a shaft part, a weight, a supporting part, and biasing means. The shaft part is supported by the casing and is extended in a direction perpendicular to the direction of the reciprocating motion of a tip tool. The weight is disposed to be away from the shaft part. The supporting part supports the weight part so that the weight part is swingable about the shaft part. The biasing means biases the weight so as to return it to a predetermined position with respect to the casing in the swinging direction.

However, in the impact tool described in Patent Literature 2, the working point by which the vibration applying force of the weight of the vibration reducing mechanism is transmitted to the casing is at a location deviated from the center line of a moving member; therefore, it has been difficult to effectively reduce the vibrations of the casing generated on the center line.

An object of the present invention is to provide an impact tool capable of effectively reducing the vibrations generated in a casing.

According to the present invention, the vibrations generated in a casing can be effectively reduced.

Hereinafter, the fourth embodiment of the present invention will be described in detail with reference to FIG. 3, FIG. 4, FIG. 5, FIG. 7, FIG. 8, FIG. 10, and FIG. 11.

Figure 10:
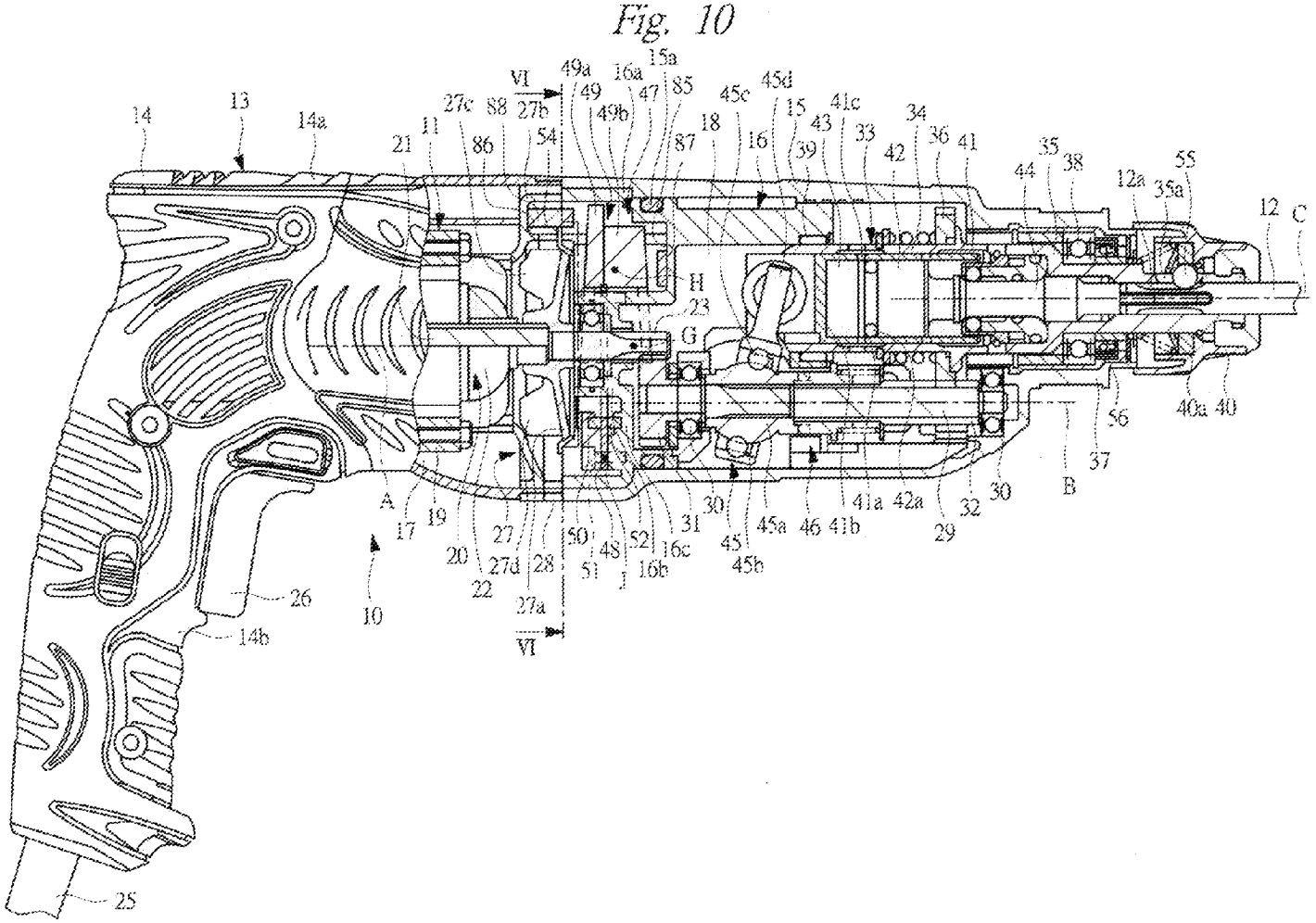
FIG. 10 is a vertical cross-sectional view showing an impact tool according to another embodiment of the present invention.
Figure 11:
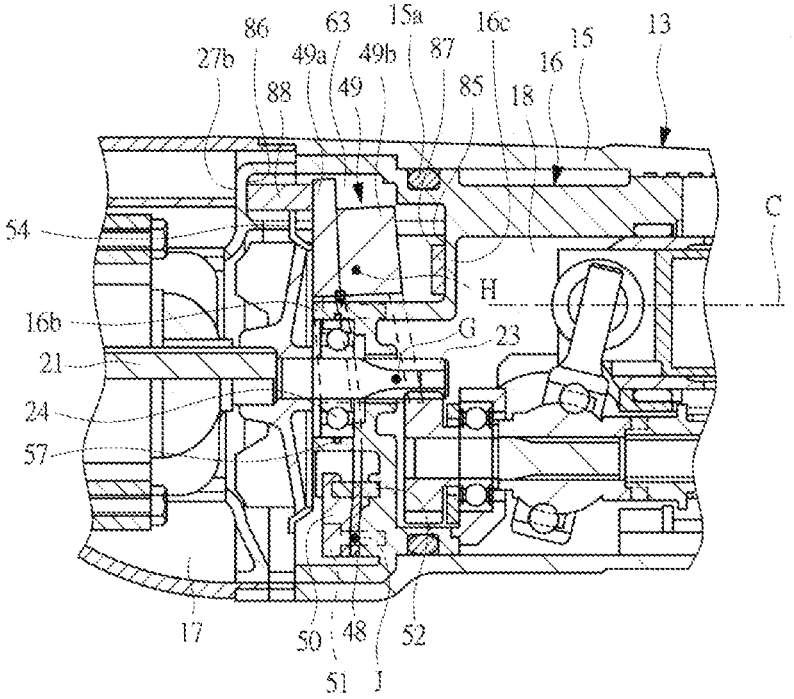
FIGS. 11(A) and 11(B) are cross-sectional views for describing the working of the vibration reducing mechanism provided in the impact tool shown in FIG. 10.
Figure 11:
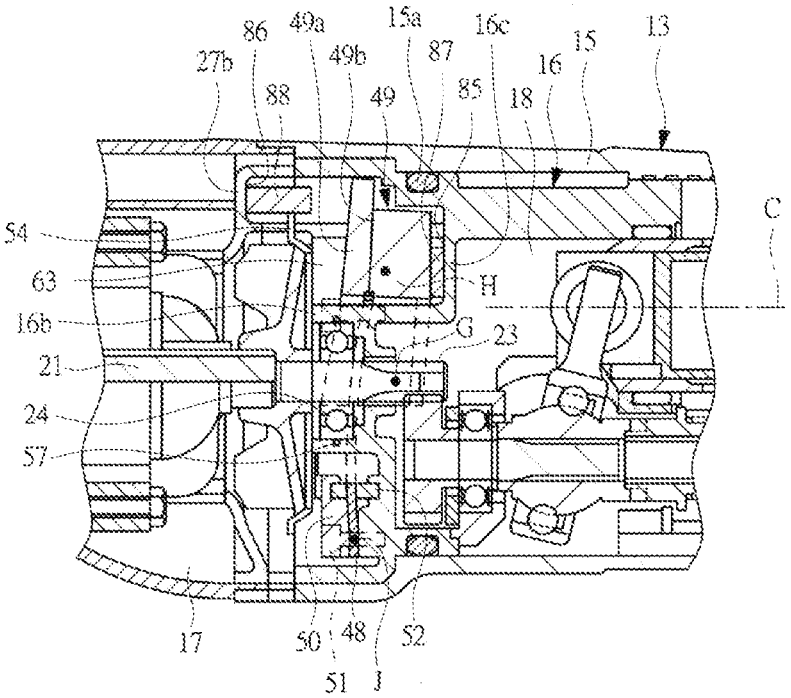

An impact tool 10 shown in FIG. 10 is a hammer drill. More specifically, the impact tool 10 has a function of transmitting power of a motor such as an electric motor 11 to a tip tool 12 and rotating the tip tool 12 and a function of converting rotary motion of the electric motor 11 to impact force imparted to the tip tool 12. The impact tool 10 has a casing 13, and the casing 13 has a housing 14 and a gear cover 15. The housing 14 has a tubular body part 14*a* and a handle part 14*b* which is continuous with one end of the body part 14*a*. The handle part 14*b* is a part which is held by a hand of an operator who uses the impact tool 10. The housing 14 and the gear cover 15 are fixed by a fastening member in a state in which an open end of the body part 14*a* on the opposite side of the handle part 14*b* and one open end of the gear cover 15 are in contact with each other. The fastening member is not shown for the sake of convenience.

The gear cover 15 is formed into a tubular shape, and an inner cover 16 is provided in the gear cover 15. The inner cover 16 is made of a metal material having excellent thermal conductivity such as aluminum. The interior of the casing 13 is separated by the inner cover 16 into a first housing chamber 17 formed in the body part 14*a* and a second housing chamber 18 formed in the gear cover 15. In other words, the inner cover 16 functions as a partition wall.

The electric motor 11 is provided in the first housing chamber 17. The electric motor 11 has a stator 19 fixed to the housing 14 and a rotor 20 provided rotatably. The rotor 20 is rotatable about an axis A, and the stator 19 is disposed on an outer side of the rotor 20 in the radial direction about the axis A. The axis A is disposed in the horizontal direction in FIG. 10 for the sake of convenience. The rotor 20 has an output shaft 21 and a coil 22 attached to the output shaft 21. An output gear 23 is formed on an outer peripheral surface of the output shaft 21.

The inner cover 16 has an outer tube part 16*a* and an inner tube part 16*b* provided coaxially with the outer tube part 16*a*. The inner tube part 16*b* is provided inside the outer tube part 16*a*. An O-ring 15*a* serving as a sealing member is interposed between the outer peripheral surface of the inner cover 16 and the inner peripheral surface of the gear cover 15. Furthermore, the inner cover 16 has an overhang part 16*c* which connects an end part of the outer tube part 16*a* and an end part of the inner tube part 16*b* in the direction along the axis A. The overhang part 16*c* is extended in the radial direction about the axis A. As shown in FIG. 11(A), the inner tube part 16*b* has a cylindrical shape, and a bearing 24 is attached to the inner peripheral surface of the inner tube part 16*b*. An O-ring 57 serving as a sealing member is attached between the inner peripheral surface of the inner tube part 16*b* and an outer ring of the bearing 24. The bearing 24 is a sealed bearing having a sealing member attached between the inner ring and the outer ring.

Moreover, a bearing is provided at a location which is in the first housing chamber 17 and near the handle part 14*b*. This bearing and the bearing 24 are disposed coaxially with each other, and the output shaft 21 is supported by the two bearings to be rotatable about the axis A. In this manner, the two bearings are disposed at two different locations in the direction along the axis A. One end of the output shaft 21 is disposed in the second housing chamber 18, and the output gear 23 is provided at a part of the output shaft 21 disposed in the second housing chamber 18.

Moreover, in the first housing chamber 17, a brush which supplies power to the coil 22 is provided. A power-supply cord 25 is attached to the handle part 14*b*, and the power-supply cord 25 is connected to an external power supply. A trigger 26 is provided at the handle part 14*b*, and a control circuit is provided in the handle part 14*b*. This control circuit carries out control and others for supplying the electric power, which is supplied through the power-supply cord 25, to the brush. When the trigger 26 is operated, the electric motor 11 distributes electric power to the coil 22 through the power-supply cord 25, so that a rotating magnetic field is formed between the rotor 20 and the stator 19 and the rotor 20 is rotated.

A fan 27 is provided in the first housing chamber 17 and between the coil 22 and the inner cover 16 in the direction along the axis A. The fan 27 is a mechanism for forming flows of air which cools the electric motor 11 and the interior of the second housing chamber 18, and the fan 27 of the present embodiment is made up of a centrifugal fan. As shown in FIG. 3, the fan 27 has a bladed wheel 27*a* attached to the output shaft 21 and a guiding wall 27*b* surrounding the outer peripheral side of the bladed wheel 27*a*. The bladed wheel 27*a* is configured to rotate integrally with the output shaft 21, and the bladed wheel 27*a* has a plurality of blades 27*d* extended from the inner side toward the outer side in the radial direction about the axis A.

The guiding wall 27*b* is provided so as to surround the periphery of the bladed wheel 27*a* within a range of a predetermined angle. The guiding wall 27*b* is provided between the stator 19 and the inner cover 16 in the direction along the axis A. The guiding wall 27*b* is fixed so as not to rotate with respect to the housing 14. The fan 27 has an air intake passage 27*c* formed between the bladed wheel 27*a* and the guiding wall 27*b*. The air intake passage 27*c* is formed from the inner side toward the outer side in the radial direction about the axis A.

As shown in FIG. 3 and FIG. 4, air holes 28 which mutually communicate the interior and the exterior of the casing 13 are provided on the outer peripheral side of the bladed wheel 27*a*, for example, at a coupling part of the housing 14 and the gear cover 15. The air holes 28 are provided for discharging the air guided by the fan 27 to the outside of the casing 13. The air holes 28 are provided at two locations on the lateral side and the lower side of the casing 13. The guiding wall 27*b* has openings at two locations opposed to the air holes 28 in the circumferential direction about the axis A.

An intermediate shaft 29 is provided in the second housing chamber 18. The intermediate shaft 29 is a power transmitting element which transmits the power of the output shaft 21 to the tip tool 12. Two bearings 30 are coaxially provided in the second housing chamber 18, and the intermediate shaft 29 is supported by the two bearings 30 to be rotatable about a center line B. The two bearings 30 are attached to the gear cover 15. The center line B is parallel to the axis A, and the center line B is disposed to be non-coaxial with the axis A. A gear 31 is provided at an end part of the intermediate shaft 29 close to the overhang part 16*c*. The gear 31 meshes with the output gear 23. A gear 32 is formed at a part of the intermediate shaft 29 between the two bearings 30.

Furthermore, a cylinder 33 is provided in the second housing chamber 18. The cylinder 33 is an element which transmits torque of the intermediate shaft 29 to the tip tool 12. The cylinder 33 has a large-diameter cylindrical part 34 and a small-diameter cylindrical part 35, which are coaxially provided about a center line C. The inner diameter of the large-diameter cylindrical part 34 is larger than the inner diameter of the small-diameter cylindrical part 35. A gear 36 is attached to the outer peripheral surface of the large-diameter cylindrical part 34. The gear 36 is provided so as to integrally rotate with the cylinder 33, and the gear 36 meshes with the gear 32. The gear 32 and the gear 36 are elements which transmit the torque of the intermediate shaft 29 to the cylinder 33.

The gear cover 15 has a cylindrical part 37 at a location on the opposite side of the housing 14 in the direction along the axis A. The inner diameter of the cylindrical part 37 is larger than the outer diameter of the large-diameter cylindrical part 34 and the outer diameter of the small-diameter cylindrical part 35. A grip part is attached to the outer peripheral surface of the cylindrical part 37, and a bearing 38 is attached to the inner peripheral surface of the cylindrical part 37. A bearing 39 is attached to the inner peripheral surface of the inner cover 16. The two bearings 38 and 39 are coaxially disposed, and the large-diameter cylindrical part 34 is rotatably supported by the bearing 39. The small-diameter cylindrical part 35 is rotatably supported by the bearing 38. Thus, the cylinder 33 can be rotated about the center line C by the two bearings 38 and 39. The center line C is parallel to the axis A and the center line B, and the center line C is non-coaxial with the axis A and the center line B.

FIG. 10 is a vertical cross-sectional view including the center line C. In FIG. 10, the axis A is positioned below the center line C, and the center line B is positioned below the axis A. All of the axis A, the center line B, and the center line C are mutually parallel. All of the axis A, the center line B, and the center line C may be positioned on the same plane, or only two center lines may be positioned on the same plane.

The cylinder 33 is positioned and fixed in the direction along the center line C with respect to the gear cover 15. Furthermore, a sealing member 56 is provided between the cylindrical part 37 and the small-diameter cylindrical part 35. The sealing member 56 is made up of, for example, a publicly known oil seal, and the sealing member 56 is provided for preventing lubrication oil sealed in the second housing chamber 18 from being leaked to the outside of the casing 13.

A tip part of the small-diameter cylindrical part 35 is exposed to the outside of the cylindrical part 37. The tip tool 12 is inserted in the small-diameter cylindrical part 35. A groove 12*a* having a length in the direction along the center line C is provided in the outer peripheral surface of the tip tool 12. On the other hand, a retaining hole 35*a* penetrating through the small-diameter cylindrical part 35 in the radial direction is provided, and a ball 55 is disposed in the retaining hole 35*a*. An end cover 40 is attached to a part of the small-diameter cylindrical part 35 which is exposed to the outside of the cylindrical part 37.

The end cover 40 is configured so as to integrally rotate with the cylinder 33, and has a holding member 40*a* which prevents the ball 55 from falling from the retaining hole 35*a*. Part of the ball 55 retained in the retaining hole 35*a* is disposed in the groove 12*a*. Thus, the ball 55 can roll in the groove 12*a*. Relative rotations of the cylinder 33 and the tip tool 12 are prevented by the engaging force of the ball 55. Thus, the torque of the cylinder 33 is transmitted to the tip tool 12 via the ball 55, and the tip tool 12 is rotated.

The tip tool 12 can be moved in the direction along the center line C with respect to the cylinder 33 based on the length of the groove 12*a* in the direction along the center line C. The end cover 40 is configured so as to be attachable and detachable to/from the cylinder 33. Then, the ball 55 gets out of the retaining hole 35*a* by the operation of the end cover 40, so that the tip tool 12 can be replaced.

A piston 41 is inserted in the large-diameter cylindrical part 34. The piston 41 is reciprocable in the direction along the center line C in the large-diameter cylindrical part 34. The piston 41 has a cylindrical part 41*a* and a bottom part 41*b* formed to be continuous with the cylindrical part 41*a*. An open part of the cylindrical part 41*a* is disposed on the small-diameter cylindrical part 35 side. An air hole 41*c* penetrating in the radial direction is provided in the cylindrical part 41*a*, and a striker 42 is inserted in the cylindrical part 41*a*. The striker 42 is movable in the direction along the center line C with respect to the piston 41, and a pneumatic chamber 43 is formed between the striker 42 and the bottom part 41*b* in the cylindrical part 41*a*. The volume of the pneumatic chamber 43 is set so that the impact force generated by the reciprocating motion of the piston 41 reaches a target value. An O-ring 42*a* is attached to the outer peripheral surface of the striker 42, and the O-ring 42*a* maintains the air tightness between the striker 42 and the piston 41.

In the cylinder 33, an intermediate element 44 is provided between the striker 42 and the tip tool 12. In other words, the intermediate element 44 is disposed between the striker 42 and the tip tool 12 in the direction along the center line C, and the intermediate element 44 is movable in the direction along the center line C with respect to the cylinder 33. The intermediate element 44 is an element which transmits the impact force, which has been applied to the striker 42 as a result of the pressure increase in the pneumatic chamber 43, to the tip tool 12. The intermediate element 44 can be in contact or non-contact with the striker 42 and the tip tool 12.

On the other hand, in the second housing chamber 18, a motion converting mechanism 45 which converts the rotary motion of the intermediate shaft 29 to reciprocating motion of the piston 41 is provided. The motion converting mechanism 45 has an inner ring 45*a* and an outer ring 45*b*. The inner ring 45*a* is attached to the outer peripheral surface of the intermediate shaft 29. The inner ring 45*a* is relatively rotatable with the intermediate shaft 29. The outer peripheral surface of the inner ring 45*a* has an arc shape as the cross-sectional shape thereof in a plane including the center line B, and a groove is formed in the outer peripheral surface of the inner ring 45*a*. In accordance with the phase variation of the inner ring 45*a* in the circumferential direction, the position of the groove in the direction along the center line B is varied. A plurality of rolling elements 45*c* are interposed between the outer ring 45*b* and the inner ring 45*a* in a circumferential direction. The rolling elements 45*c* can roll along the groove. A coupling rod 45*d* is provided at the outer ring 45*b*, and the coupling rod 45*d* is coupled to the piston 41. Therefore, the outer ring 45*b* is not rotated about the center line B.

Furthermore, a clutch 46 is provided in the second housing chamber 18. The clutch 46 is a mechanism for connecting and disconnecting a power transmitting path between the inner ring 45*a* and the intermediate shaft 29. The clutch 46 integrally rotates with the intermediate shaft 29 and is movable in the direction along the center line B with respect to the intermediate shaft 29. When the clutch 46 is moved to the left side along the center line B and stopped, the power transmitting path between the intermediate shaft 29 and the inner ring 45*a* is connected. In other words, the clutch 46 is brought into an engaged state. On the other hand, when the clutch 46 is moved to the right side along the center line B and stopped, the power transmitting path between the intermediate shaft 29 and the inner ring 45*a* is disconnected. In other words, the clutch 46 is brought into a released state. Note that the move of the clutch 46 in the direction along the center line B, the stop thereof, and the direction of the move are switched when the operator operates a mode selector switch. The mode selector switch is provided on the outer surface of the casing 13, but is not shown for the sake of convenience.

When the intermediate shaft 29 rotates in the state in which the clutch 46 is engaged, the rolling elements 45*c* roll along the groove, and the outer ring 45*b* swings about a center point on the center line B within a range of a predetermined angle. Note that the center point is not shown for the sake of convenience. When the outer ring 45*b* swings within a range of a predetermined angle, the piston 41 reciprocates in the direction along the center line C.

Working of the impact tool 10 configured in the above-described manner will be described. First, the operator holds the handle part 14*b* with one hand, holds the grip part with the other hand, presses the tip tool 12 to an object, and pulls the trigger 26. Then, electric power is supplied to the electric motor 11, the rotor 20 rotates, and the torque of the output shaft 21 is transmitted to the intermediate shaft 29 via the output gear 23 and the gear 31. The torque of the intermediate shaft 29 is transmitted to the cylinder 33 via the gear 32 and the gear 36. The torque of the cylinder 33 is transmitted to the tip tool 12 via the ball 55.

When the mode selector switch is operated to select a driver mode during the working described above, the clutch 46 is brought into the released state. Therefore, the rotary motion of the intermediate shaft 29 is not converted to reciprocating motion of the piston 41. Therefore, impact force is not applied to the tip tool 12. On the other hand, when the mode selector switch is operated to select a hammer driver mode, the clutch 46 is brought into the engaged state. Therefore, the rotary motion of the intermediate shaft 29 is converted to the reciprocating motion of the piston 41. When the O-ring 42*a* of the striker 42 is positioned on the tip tool 12 side relative to the air hole 41*c*, the pneumatic chamber 43 is communicated with the outside of the piston 41 via the air hole 41*c*. When the tip tool 12 is pressed to a material to be ground, the striker 42 is moved to the left side in FIG. 10. As a result, the air hole 41*c* is closed by the striker 42. Then, when the piston 41 is moved rightward in FIG. 10, the pressure in the pneumatic chamber 43 is increased, and impact force is generated. The generated impact force is transmitted to the tip tool 12 via the striker 42 and the intermediate element 44.

Therefore, the tip tool 12 is struck while being rotated. When the striker 42 is moved to the right side in FIG. 10, the air hole 41*c* is opened, and the pneumatic chamber 43 is communicated with the atmospheric air to reduce the pressure thereof. Therefore, the impact force is reduced, and the striker 42 is stopped. Thereafter, the above-described working is repeated along with the reciprocating motion of the piston 41.

Incidentally, when the piston 41 repeats the reciprocating motion, vibrations in the direction along the center line C are generated due to the reaction force at the time of generating the impact force, working of the piston 41, and others. The vibrations are transmitted to the casing 13 via the cylinder 33 and the bearings 38 and 39 or transmitted to the casing 13 via the motion converting mechanism 45, the intermediate shaft 29, and the bearing 30. As a result, the casing 13 is vibrated. An example of the vibrated state of the casing 13 will be described based on FIG. 5. For example, the casing 13 vibrates in an arc-shaped trajectory about a swinging center D within a range of a predetermined angle, that is, swings. The swinging center D is an intersection point of a first line segment E and a second line segment F. The first line segment E passes through the tip of the tip tool 12 and the center point of the handle part 14*b* in a longitudinal direction. The second line segment F passes through the gravity center G of the casing 13 and is orthogonal to the axis A. In FIG. 5, the gravity center G of the casing 13 is shown on the axis A. The vibrated state of the casing 13 shown in FIG. 5 merely shows just one analyzed example.

The impact tool 10 of the fourth embodiment has a vibration reducing mechanism 47 which reduces the vibrations of the casing 13. The configuration of the vibration reducing mechanism 47 will be described based on FIG. 5, FIG. 7, FIG. 8, FIG. 10, and FIG. 11. The vibration reducing mechanism 47 has a supporting member 48 which is attached to the overhang part 16*c* and a weight 49 which is supported by the supporting member 48. The supporting member 48 is formed of an elastic member such as a metal material having elasticity, preferably, a plate spring. The supporting member 48 has a base part 48*a* and two arm parts 48*b* branched from the base part 48*a*. The opposing parts of the two arm parts 48*b* are formed to have arc shapes. The base part 48*a* is sandwiched by the overhang part 16*c* of the inner cover 16 and a mount member 50 and is fixed to the overhang part 16*c* by screws 51. The fixing position J at which the supporting member 48 is fixed by the screws 51 is positioned below the center line B. Furthermore, a rubber member 52 which is an elastic member for absorbing the vibrations of the supporting member 48 is attached to the base part 48*a* of the supporting member 48.

The weight 49 is attached to free ends of the two arm parts 48*b*. The weight 49 is made of, for example, a metal material. The weight 49 has a C-shape in the plane perpendicular to the axis A, and the inner peripheral surface of the weight 49 is formed to have an arc shape. The weight 49 has two constituent pieces 49*a* and 49*b* attached so as to sandwich the two arm parts 48*b*. In the direction along the axis A, the constituent piece 49*b* is disposed at a position close to the overhang part 16*c* compared with the constituent piece 49*a*. Also, in the direction along the axis A, the constituent piece 49*b* is thicker than the constituent piece 49*a*. Therefore, in the entire weight 49, the width in the direction along the axis A from the supporting member 48 serving as a center is larger in the constituent piece 49*b* which is positioned on the opposite side of the electric motor 11 than in the constituent piece 49*a*. The opposite side of the electric motor 11 means the motion converting mechanism 45 side. In FIG. 5, the gravity center H of the weight 49 is disposed above the center line C. Between the weight 49 and the two arm parts 48*b*, a shaft hole 53 is provided in the plane perpendicular to the axis A. The inner tube part 16*b* is disposed in the shaft hole 53. Thus, the vibration reducing mechanism 47 is provided so as to surround the inner tube part 16*b* in the plane perpendicular to the axis A.

The natural vibration frequency of the vibration reducing mechanism 47 is set to be equal to the striking frequency in a boring operation. The natural vibration frequency of the vibration reducing mechanism 47 is determined by such conditions as the mass of the weight 49, the rigidity of the supporting member 48, and the length from the fixing position of the supporting member 48 to the gravity center H of the weight 49. If the supporting member 48 has spring elasticity, the spring constant of the supporting member 48 is a factor to determine the natural vibration frequency. The inner diameter of the shaft hole 53 is set to a value with which the vibration reducing mechanism 47 and the inner tube part 16*b* are not brought into contact with each other when the supporting member 48 and the weight 49 swing.

The vibration reducing mechanism 47 having the above-described configuration vibrates about the swinging center D of the casing 13. Specifically, the supporting member 48 is elastically deformed with using the fixing position J as a supporting point and vibrates in the opposite directions of the vibrations of the casing 13, thereby reducing and absorbing the vibrations of the casing 13. "The supporting member 48 vibrates in the opposite directions" can be translated into "the supporting member 48 vibrates in the opposite phases" in other words. When the supporting member 48 and the weight 49 vibrate, the rubber member 52 is elastically deformed so as to be crushed by the mount member 50 and the supporting member 48, thereby absorbing the vibrations.

Particularly, in order to effectively reduce the vibrations caused at the time of striking, the vibration reducing mechanism 47 is provided with struck parts 85 and 86 as shown in FIG. 11(A) and FIG. 11(B). The struck parts 85 and 86 are working points of force. The struck parts 85 and 86 are disposed on the center line C serving as a striking axis or at locations deviated from the center line C. FIG. 10 shows a plane including the center line C and the center line B. The struck parts 85 and 86 are provided at locations deviated in the radial direction about the center line C on the plane. The struck part 85 is a part to which force is transmitted via an elastic body 87 when the weight 49 reaches a predetermined amplitude. The struck part 86 is a part to which force is transmitted via an elastic body 88 when the weight 49 reaches a predetermined amplitude. The elastic bodies 87 and 88 may be provided on the weight 49 which is a movable element, but it is preferred that the elastic bodies are provided on the casing which is a fixed element from the viewpoints of manufacturability and durability. The struck part 85 is provided at a front part in the direction along the center line C. The struck part 86 is provided at a rear part in the direction along the center line C. The struck part 85 is provided at the overhang part 16*c* of the inner cover 16. The struck part 86 is provided at the guiding wall 27*b* of the fan 27.

It is preferred that the struck parts 85 and 86 are formed to have a planar shape orthogonal to the center line C in order to receive the impact force uniformly in the plane. A front surface part of the constituent piece 49*b* of the weight 49 is inclined so that the thickness of the constituent piece 49*b* is reduced toward the tip side in order that the front surface part becomes parallel to the struck part 85 when the constituent piece 49*b* abuts on the elastic body 87. A rear surface part of the constituent piece 49*a* of the weight 49 is inclined so that the thickness of the constituent piece 49*a* is reduced toward the tip side in order that the rear surface part becomes parallel to the struck part 86 when the constituent piece 49*a* abuts on the elastic body 88.

The elastic body 87 provided at the front part in the direction along the center line C is formed of a plate-like rubber member. The elastic body 87 is fixed to a flat lateral surface of the overhang part 16*c* positioned on the constituent piece 49*b* side. The elastic body 87 is attached to the overhang part 16*c* by fixing means such as an adhesive agent. The elastic body 87 is provided between the weight 49 and the overhang part 16*c* in the direction along the center line C. Thus, the elastic body 87 is disposed at a position close to the tip tool 12 compared with the weight 49 in the direction along the center line C.

The elastic body 88 provided at the rear part in the direction along the center line C is attached to the guiding wall 27*b*. In other words, the elastic body 88 is provided at a position having a longer distance from the tip tool 12 than that of the weight 49 in the direction along the center line C. The fan 27 is disposed between the guiding wall 27*b* and the constituent piece 49*a*. Therefore, the elastic body 88 is formed like a rod having a predetermined length in the direction along the center line C in order to fill the space in which the fan 27 is disposed in the direction along the center line C. The elastic body 88 is integrally formed of a rubber member. The elastic body 88 is attached to the guiding wall 27*b* by fixing means such as an adhesive agent. The fixing means is not limited to an adhesive material, but may be a recessed part, a screw, or the like which holds the elastic body. In this manner, the elastic bodies 87 and 88 are attached to the elements provided in the casing 13.

Figure 8:
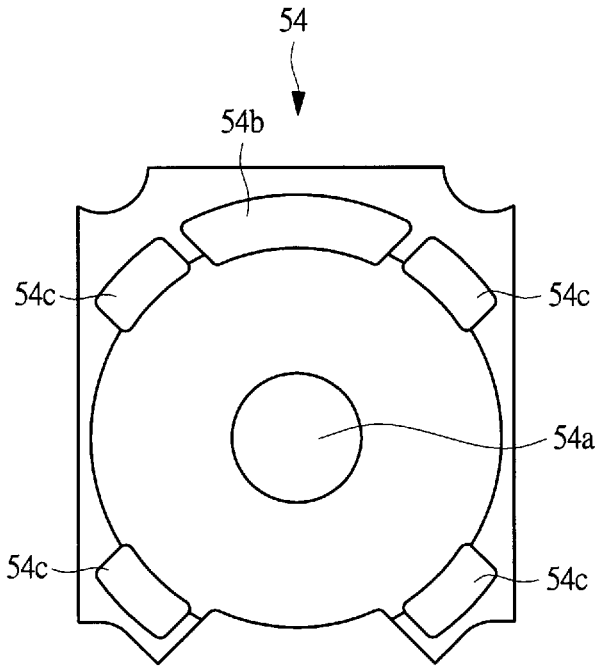
FIG. 8 is a lateral view showing a configuration of a plate provided in the impact tool shown in FIG. 1.

The vibration reducing mechanism 47 and the fan 27 are disposed to be arranged in the direction along the axis A. Therefore, if the amplitude of vibrations is large when the supporting member 48 and the weight 49 vibrate, the weight 49 may contact the fan 27, specifically, the bladed wheel 27*a*. For this reason, in the first housing chamber 17, a plate 54 which prevents the weight 49 from contacting the bladed wheel 27*a* is provided. The plate 54 is integrally formed of a metal plate, and the plate 54 is fixed to the casing 13. The plate 54 has a shaft hole 54*a* penetrating therethrough in the direction along the axis A as shown in FIG. 8, and the output shaft 21 and a boss part of the bladed wheel 27*a* are inserted in the shaft hole 54*a*. An inner peripheral end of the plate 54 is disposed between the fan 27 and the inner tube part 16*b* in the direction along the axis A. The vibration reducing mechanism 47 is disposed in the housing chamber 63 surrounded by the plate 54 and the inner cover 16.

The vibration reducing mechanism 47 and the fan 27 are arranged and disposed in the direction along the axis A parallel to the center line C. Therefore, since the elastic body 87 or the elastic body 88 abuts on the weight 49, the weight 49 can be prevented from excessively swinging and abutting on the fan 27 or the plate 54 provided between the fan 27 and the vibration reducing mechanism 47.

Moreover, in the plate 54, an air hole 54*b* is provided at a location corresponding to an outer peripheral end of the bladed wheel 27*a*. The air hole 54*b* is provided to have the shape of an arc about the axis A. The air hole 54*b* is a path which guides the flow of air, which has been formed by the rotation of the bladed wheel 27*a*, toward the inner cover 16. Moreover, the plate 54 is provided with a plurality of attachment holes 54*c* which penetrate therethrough in the thickness direction.

Figure 7:
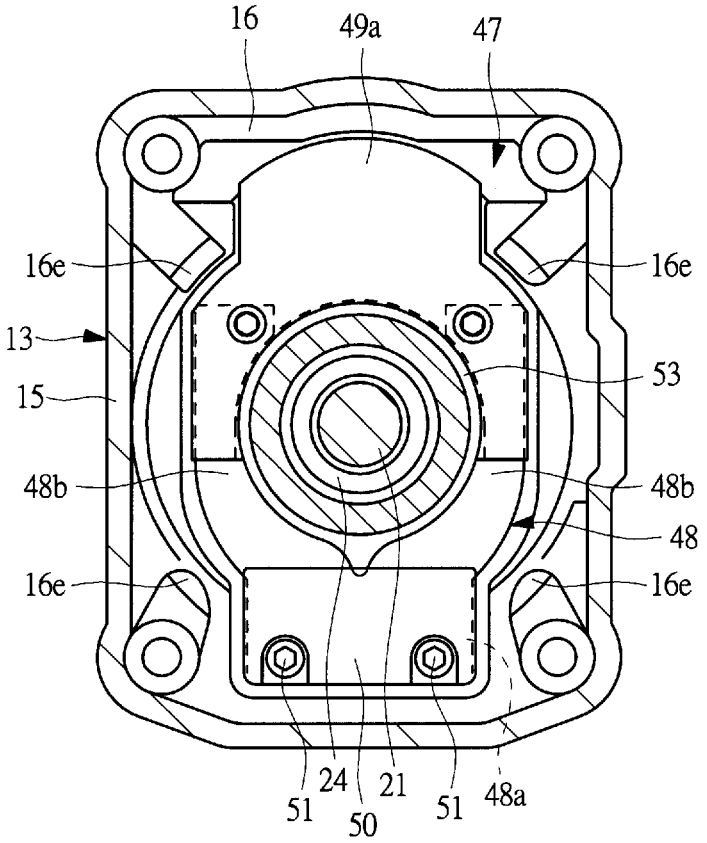
FIG. 7 is a cross-sectional view taken along the line VII-VII of FIG. 1.

On the other hand, as shown in FIG. 7, the inner cover 16 is provided with a plurality of latching claws 16*e*, and the latching claws 16*e* are inserted in the attachment holes 54*c*. By virtue of this structure, the plate 54 is positioned and fixed with respect to the casing 13 in the circumferential direction about the axis A. In the above-described embodiment, the bearings 24, 30, and 38 have a function of receiving both of thrust load and radial load.

On the other hand, a lubricated part is provided in the second housing chamber 18. The lubricated part includes meshed parts of the output gear 23 and the gear 31, meshed parts of the gear 32 and the gear 36, the motion converting mechanism 45, and contact parts of the piston 41 and the cylinder 33. The lubrication oil which lubricates and cools the lubricated part is sealed in the second housing chamber 18. The sealing member 56 prevents the lubrication oil in the second housing chamber 18 from being leaked to the outside of the casing 13 via the space between the small-diameter cylindrical part 35 and the cylindrical part 37. The O-ring 15*a* prevents the lubrication oil in the second housing chamber 18 from being leaked to the first housing chamber 17 via the space between the inner cover 16 and the gear cover 15. Furthermore, the sealing member attached to the bearing 24 prevents the lubrication oil in the second housing chamber 18 from being leaked to the first housing chamber 17.

In the fourth embodiment, the fixing position J of the supporting member 48 is below the center line B as shown in FIG. 5. The supporting member 48 and the weight 49 vibrate with using the fixing position J as a supporting point, and the vibration trajectory of the weight 49 has an arch shape. More specifically, when the casing 13 vibrates in the arc shape about the swinging center D, the vibration trajectory of the casing 13 and the vibration trajectory of the weight 49 can be caused to approximate each other as much as possible, and vibration reducing efficiency is improved. The center line C and the gravity center H of the weight 49 are set to be as close as possible in the radial direction about the center line C. Therefore, the vibration reducing mechanism 47 can effectively vibrate the weight 49, and the vibration reducing effect is improved.

Furthermore, the disposed positions of the bearing 24 and the weight 49 in the direction along the axis A are at least partially overlapped with each other. The vibration reducing mechanism 47 is disposed on an outer side of the output gear 23 in the radial direction about the axis A. Furthermore, the disposed positions of the vibration reducing mechanism 47 and the output gear 23 in the direction along the axis A are partially overlapped with each other. The axis A and the center line C are parallel to each other. Therefore, the disposing space of the bearing 24 and the vibration reducing mechanism 47 can be shortened as much as possible in the direction along the center line C. Therefore, increase in the size of the impact tool 10 can be suppressed.

The vibration reducing mechanism 47 is disposed on an outer side of the inner tube part 16*b* in the radial direction about the axis A, and the output gear 23 is disposed on an inner side of the inner tube part 16*b*. Therefore, the length of the output shaft 21 from the part supported by the bearing 24 to the end part including the part at which the output gear 23 is formed can be shortened as much as possible. Therefore, the output shaft 21 can be supported by the single bearing 24 on the output gear 23 side, and the number of parts can be reduced.

Moreover, since the output shaft 21 is inserted in the shaft hole 53 of the vibration reducing mechanism 47, the disposing space of parts in the direction along the axis A can be narrowed. Moreover, even when the vibration reducing mechanism 47 vibrates, contact with the output shaft 21 can be avoided. Furthermore, even when the vibration reducing mechanism 47 vibrates, contact with the cylindrical part 16*d* can be avoided.

The fan 27 in the present embodiment is rotated by the torque of the rotor 20 of the electric motor 11 and takes in the air in the first housing chamber 17. In the first housing chamber 17, a flow of air is formed by the rotation of the fan 27. The electric motor 11 exchanges heat with the flowing air, and temperature increase of the electric motor 11 is suppressed. The air of the first housing chamber 17 passes through the air intake passage 27*c* and is guided toward outside in the radial direction. The guided air passes through the air hole 54*b* of the plate 54 and flows into the space between the plate 54 and the inner cover 16. The air which has flown into the space between the plate 54 and the inner cover 16 flows along the surface of the overhang part 16*c* of the inner cover 16 and then flows along the surface of the inner tube part 16*b* in the shaft hole 53.

The heat in the second housing chamber 18 is transmitted to the inner cover 16. The heat transmitted to the inner cover 16 is transmitted to the air flowing along the inner cover 16, and the temperature of the air is increased. The air whose temperature has been increased passes through the air hole 28 and is discharged to the outside of the casing 13. In this manner, temperature increase in the second housing chamber 18 is suppressed.

Therefore, leakage of the lubrication oil to the outside of the casing 13 or leakage of the lubrication oil in the second housing chamber 18 to the first housing chamber 17 caused by reduction in the viscosity of the lubrication oil sealed in the second housing chamber 18 can be prevented. Moreover, the change or deterioration of the characteristics of the rubber member 52 attached to the supporting member 48 can be prevented. Furthermore, deviation of the impact force from a target value caused by change in the pneumatic pressure of the pneumatic chamber 43 due to temperature increase in the second housing chamber 18 can be prevented.

Since the constituent piece 49*b* is wider than the constituent piece 49*a*, the bearing 24 can be disposed to be close to the electric motor 11 without reducing the vibration reducing effect. Particularly, when the fan 27 is provided between the bearing 24 and the electric motor 11, the fan 27 and the bearing 24 can be disposed to be close to each other as much as possible in the direction along the axis A. Furthermore, since the weight 49 is disposed on the opposite side of the intermediate shaft 29 with the output shaft 21 interposed therebetween, when the weight 49 vibrates, the weight 49 can be prevented from interfering with the intermediate shaft 29.

Also, since the fixing position J at which the force for reducing the vibrations is transmitted to the casing 13 when the weight 49 vibrates is close to the gravity center G of the impact tool 10 in the direction along the center line C, vibrations can be effectively reduced. Furthermore, the fixing position J is away from the center line C compared with the gravity center G of the impact tool 10 in the direction along the center line C, and the distance from the fixing position J to the weight 49 is made long in the radial direction about the axis A; therefore, the quantity of the vibrations of the weight 49 can be increased.

Furthermore, the axis A of the output shaft 21 is disposed to be parallel to and non-coaxial with the center line C. Therefore, the size of the impact tool 10 in the direction along the center line C can be reduced, the gravity center G of the impact tool 10 and the fixing position J of the weight 49 can be caused to be close to each other in the direction along the center line C, and generation of rotation moment due to the vibrations of the weight 49 can be suppressed.

Particularly, the vibration reducing mechanism 47 has: the supporting member 48 which is attached to the casing 13 so as to be swingable in the direction along the center line C of the piston 41; the weight 49 which is attached to the supporting member 48; and the struck parts 85 and 86 which are provided on the casing 13 and to which impact force is transmitted via the elastic bodies 87 and 88 when the weight 49 reaches a predetermined amplitude. Therefore, the vibrations generated in the casing 13 can be effectively reduced.

Since the elastic bodies 87 and 88 are attached to the struck parts 85 and 86, manufacturability and durability can be improved compared with the case in which they are provided on the weight 49. The struck parts 85 and 86 are provided at the front part and the rear part on or in the vicinity of the center line C in order to cancel out the vibrations generated in the casing 13 in the direction along the center line C. Therefore, the vibrations generated in the casing 13 in the direction along the center line C can be effectively reduced. Since the struck parts 85 and 86 are formed to have a planar shape orthogonal to the direction of the center line C, the elastic bodies 87 and 88 can be easily provided, and the shock caused at the time of striking can be dispersed and absorbed effectively. Since the elastic bodies 87 and 88 are formed of rubber members, the elastic bodies 87 and 88 can be easily manufactured, and cost can be reduced.

The above-described piston 41 corresponds to a moving member of the present invention, the elastic body 87 corresponds to a first elastic body of the present invention, and the elastic body 88 corresponds to a second elastic body of the present invention.

The present invention is not limited to the fourth embodiment, and it goes without saying that various modifications can be made within a range not departing from the gist thereof. For example, the struck parts are preferably provided at both of the front part and the rear part at the locations on the center line or deviated from the center line in order to absorb the vibrations in the direction along the center line generated in the casing, but the struck part may be provided at only one of them, for example, at the front part. Also, although the electric motor is shown as an example of a motor, the motor may be an air motor.

In the above-described embodiment, the impact tool is only required to be able to apply impact force to the tip tool, and the impact tool may be configured to be unable to rotate the tip tool. Also, the impact tool may be configured to be able to select the three modes of a hammer only mode, a drill only mode, and a hammer drill mode. The hammer only mode is a mode in which only impact force is applied to the tip tool, the drill only mode is a mode in which only rotative force is applied to the tip tool, and the hammer drill mode is a mode in which impact force and rotative force are applied to the tip tool. The tip tool may be a driver bit for fastening screw members. Furthermore, the tip tool may be a drill bit for boring or chipping concrete, stone materials, and others.

Furthermore, the fan provided in the casing may be an axial flow fan. The weight may be provided with, for example, a hole, a notch, or a groove for communicating air. Furthermore, the impact tool can be used in any of the states including the state in which the first to third center lines are along the perpendicular direction, the state in which they are along the horizontal direction, and the state in which they are along a direction between the horizontal direction and the perpendicular direction. Furthermore, the gravity center of the impact tool can be used as a criterion of analysis of the vibrations of the tool main body instead of the gravity center of the casing. The gravity center of the impact tool is the center of the total mass of the mass of the casing and the mass of the parts, mechanisms, elements, and others provided in the casing. Still furthermore, the impact tool may have a structure in which a battery which supplies electric power to the electric motor is housed in the casing or a structure in which a battery with a cassette structure is attached to the casing.

Fifth Embodiment

An impact tool of the fifth embodiment of the present invention will be described.

The present invention relates to an impact tool and particularly relates to an impact tool which has a reciprocating member and is required to be downsized.

Conventionally, a hammer drill serving as an impact tool which rotates a drill bit and applies impact force to the drill bit has been known. The hammer drill is a tool which applies impact tool to a striker. The hammer drill is provided with a housing, a motor, a piston, a motion converting mechanism, and the striker. The motor is supported by the housing. A cylinder and the piston are provided in the housing. The motion converting mechanism is provided in the housing. The motion converting mechanism is a mechanism which converts rotary motion of the motor to reciprocating motion of the piston.

The piston has a tubular part having an approximately cylindrical shape and a cover part which is connected to one end of the tubular part in an axial direction to close the one end of the tubular part in the axial direction. The piston is coupled to the motion converting mechanism. The motion converting mechanism causes the piston to reciprocate in the axial direction of the tubular part.

The striker is provided in the tubular part of the piston so as to be slidable in the axial direction of the tubular part. The striker forms a pneumatic chamber together with an inner surface of the cover part and an inner peripheral surface of the tubular part. The impact force generated by the reciprocating motion of the piston is applied to the striker.

A counter weight is provided in the housing. The counter weight is attached to the housing via an elastic member such as a plate spring. By virtue of this configuration, the counter weight reciprocates in parallel to the direction in which the piston and the striker reciprocate, thereby reducing the vibrations generated by the reciprocating motion of the piston and the striker. Such a hammer drill is described in, for example, Patent Literature 3.

Figure 17:
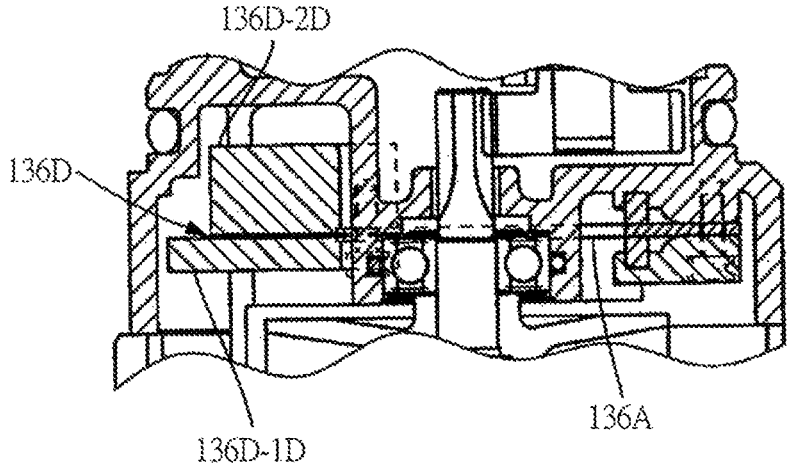
FIG. 17 is a cross-sectional view of a main part showing a state in which a counter weight of a conventional impact tool is in an initial position.
Figure 18:
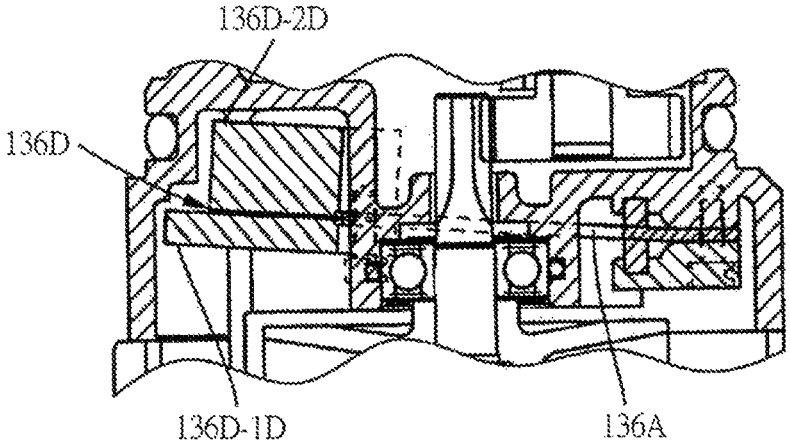
FIG. 18 is a cross-sectional view of a main part showing a state in which the counter weight of the conventional impact tool is moved maximally to the front.
Figure 19:
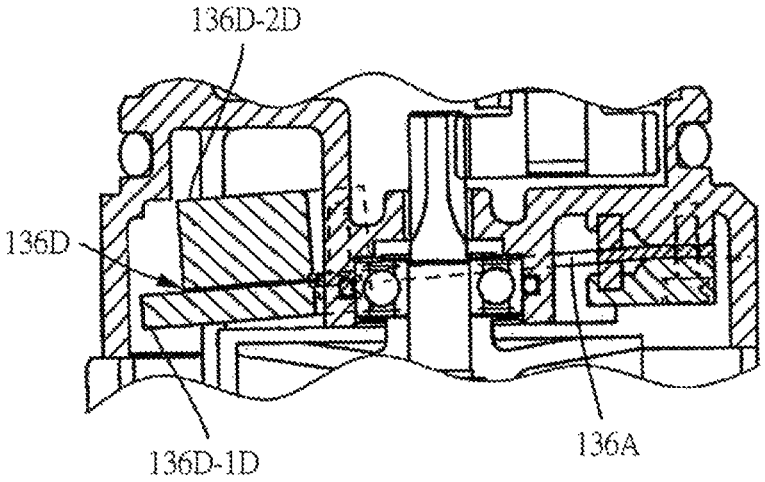
FIG. 19 is a cross-sectional view of a main part showing a state in which the counter weight of the conventional impact tool is moved maximally to the rear.

In a conceivable configuration, one end of the plate spring is fixed to the housing, a counter weight is fixed to the other end of the plate spring, and the counter weight is reciprocated with using the one end of the plate spring fixed to the housing as a swing axis point. When the counter weight is swung in this manner, as shown in FIG. 17 to FIG. 19, the counter weight 136D fixed to the other end of the plate spring 136A swings largely in the reciprocating direction. End parts 136D-1D and 136D-2D which are parts of the counter weight and away from the swing axis point swing particularly largely. Therefore, the interior space of the housing which houses the counter weight 136D has to be made large. However, downsizing has been required in an impact tool such as a hammer drill, and it has been difficult to provide the swinging counter weight 136D like that in the impact tool.

Therefore, an object of the fifth embodiment of the present invention is to provide an impact tool which is downsized and is provided with a swinging counter weight.

The fifth embodiment of the present invention can provide an impact tool which is downsized and has a structure that guides a weight.

The weight has a trapezoidal shape whose size in the swinging direction is reduced as being closer to a free end from a fixing position. When the swinging motion of the weight reaches a maximum amplitude, the distance from a first end part to a flat surface and the distance from a second end part to the flat surface are approximately equal to each other. Therefore, when the weight reaches the maximum amplitude, the first end part and the second end part can be caused to be close to a casing. As a result, the space for housing the weight can be minimized in the swinging direction of the weight, and the impact tool can be downsized.

The casing has an outer casing which constitutes an outer shell and an inner casing which is disposed in the outer casing. Also, a weight is supported by a plate spring, one end part of which is fixed to the inner casing and the other end part of which is fixed to the counter weight. Therefore, the degree of freedom of designing the structure which supports the weight can be improved.

In the weight, opposing surfaces are provided at the end parts thereof in the swinging direction, and the distances from a center position in the swinging direction of the weight to the opposing surfaces are reduced as being closer to the free end from the swing axis point. Therefore, when the weight reaches the maximum amplitude, the flat surface and the opposing surface can be caused to be close to and faced with each other in an approximately parallel positional relation. As a result, the space of housing the weight can be reduced, and the impact tool can be downsized.

The fifth embodiment of the impact tool according to the present invention will be described with reference to FIG. 12 to FIG. 16. Examples of the impact tool include an electric power tool such as a hammer drill. In the present embodiment, the impact tool 10 has a casing 13. The casing 13 has a housing 14 and a gear cover 15. An inner cover 16 is provided in the gear cover 15. Thus, the housing 14 is an outer casing serving as an outer part of the impact tool 10, that is, an element constituting an outer shell. On the other hand, the inner cover 16 is an inner casing serving as an inner part of the impact tool 10, that is, an element constituting an inner shell.

The interior of the casing 13 is separated by the inner cover 16 into a first housing chamber 17 formed in the housing 14 and a second housing chamber 18 formed in the gear cover 15. In other words, the inner cover 16 functions as a partition wall. Moreover, a handle part 14*b* is provided in the housing 14. The housing 14 and the gear cover 15 are connected to each other. An end cover 40 is attached to a location of the gear cover 15 on the opposite side of the location to which the housing 14 is connected.

The handle part 14*b* is extended from one end part of the housing 14, and the gear cover 15 is connected to the other end part of the housing 14. A power-supply cord 25 is attached to the handle part 14*b*, and a switch mechanism 60 is built in the handle part 14*b*. The handle part 14*b* is provided with a trigger 26 which is operated by a user of the impact tool 10. The switch mechanism 60 is mechanically connected to the trigger 26. The switch mechanism 60 is connected to an external power supply (not shown) by the power-supply cord 25. The switch mechanism 60 and the power supply are connected or disconnected by the operation of the trigger 26.

Herein, in the impact tool 10, in the left-right direction of FIG. 1 which is the longitudinal direction of the casing 13, the side on which the handle part 14*b* is provided is defined as a rear side, and the side on which the end cover 40 is attached is defined as a front side. Moreover, the lower side of FIG. 1 in the direction orthogonal to the approximately extending direction of the handle part 14*b* from the housing 14, that is, the front-rear direction is defined as a lower side, and the upper side of FIG. 1 is defined as an upper side. The direction from the back to the front of the paper surface of FIG. 1 is defined as a right direction, and the opposite direction thereof is defined as a left direction.

The housing 14 and the handle part 14*b* are formed by resin molding. An electric motor 11 is provided in the housing 14, specifically, in the first housing chamber 17. The electric motor 11 is provided with an output shaft 21 serving as a drive shaft, and the output shaft 21 is rotatable about an axis. The electric motor 11 outputs rotative force, that is, torque via the output shaft 21. Note that "the longitudinal direction of the casing 13" mentioned above means the direction along the axis A of the output shaft 21. The output shaft 21 is rotatably supported by a bearing 24 retained by the inner cover 16.

The inner cover 16 is provided in the gear cover 15. The inner cover 16 is made with using aluminum alloy as a base material. The inner cover 16 is formed by integral molding. The inner cover 16 is provided with a base part 61 which is fixed to the inner peripheral surface of the gear cover 15 and a cylinder supporting part 62 which is extended from the base part 61 to the front side. The base part 61 of the inner cover 16 has a tubular shape, and the outer peripheral surface of the base part 61 is in contact with the inner peripheral surface of the gear cover 15.

Also, the inner cover 16 has an overhang part 16*c* which is extended from a connecting part of the base part 61 and the cylinder supporting part 62 toward the inner side and an inner tube part 16*b* which is provided so as to be continuous with the overhang part 16*c*. The inner cover 16 is provided so as to surround the axis A of the output shaft 21. A cylindrical part 16*d* is extended from an inner peripheral end of the overhang part 16*c* toward the electric motor 11. The bearing 24 is attached to the inner periphery of the cylindrical part 16*d*. A front-side tip of the output shaft 21 is disposed in the gear cover 15, specifically, in the cylindrical part 16*d*. The front-side tip of the output shaft 21 positioned in the cylindrical part 16*d* is provided with an output gear 23. The output gear 23 integrally rotates with the output shaft 21. A fan 27 which integrally rotates with the output shaft 21 is provided between the electric motor 11 and the output gear 23. In other words, the fan 27 is provided in the first housing chamber 17.

Figure 14:
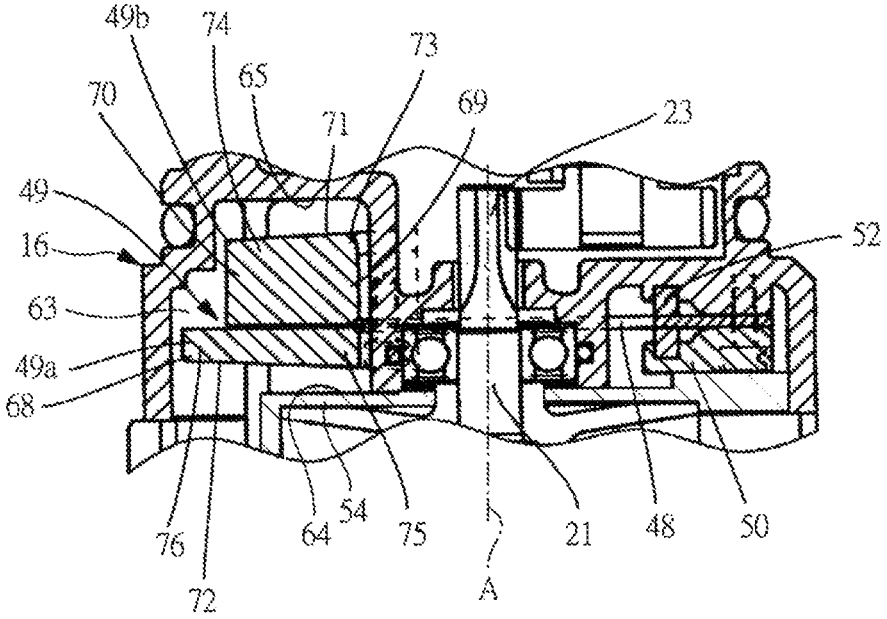
FIG. 14 is a cross-sectional view of a main part showing a state in which a counter weight of the impact tool according to the fifth embodiment of the present invention is in an initial position.
Figure 15:
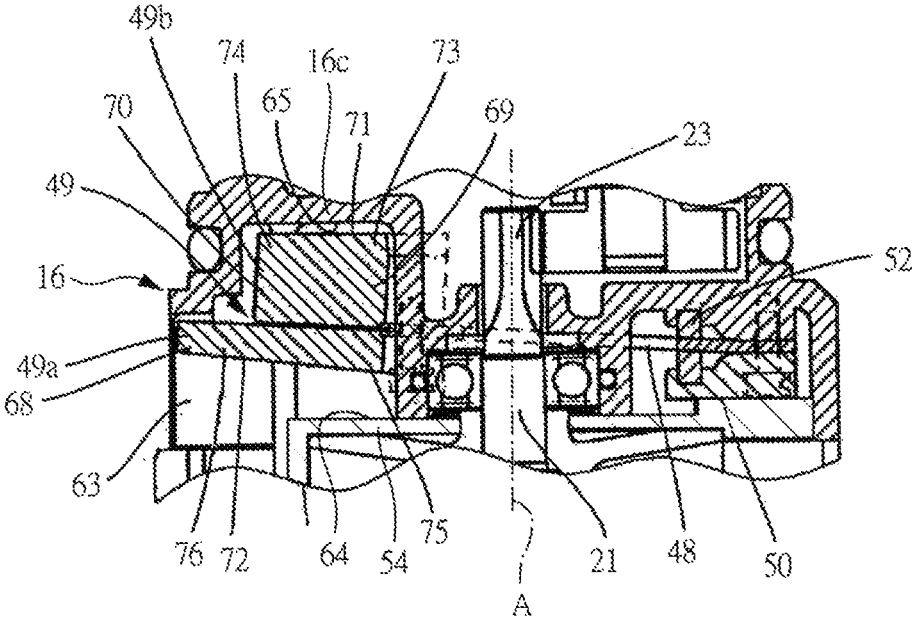
FIG. 15 is a cross-sectional view of a main part showing a state in which the counter weight of the impact tool according to the fifth embodiment of the present invention is moved maximally to the front.
Figure 16:
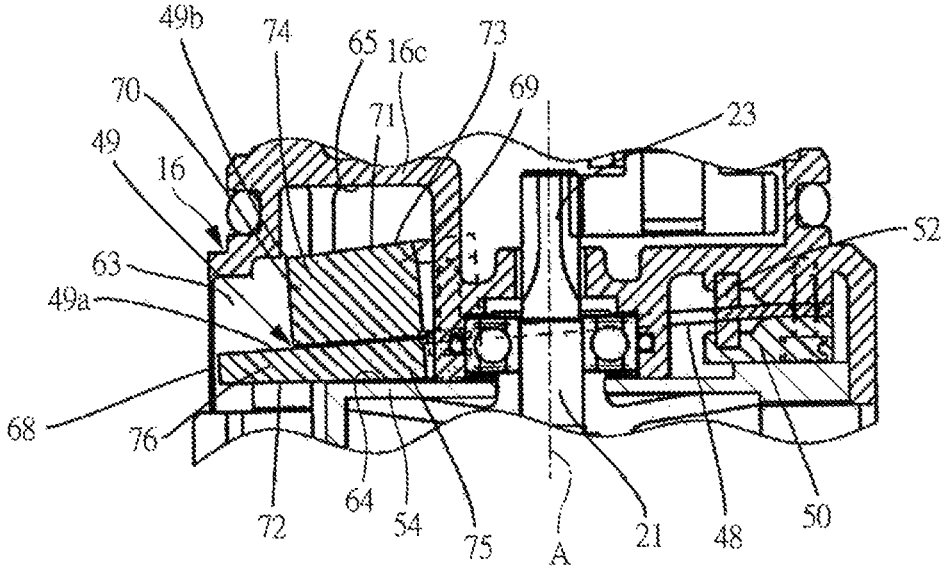
FIG. 16 is a cross-sectional view of a main part showing a state in which the counter weight of the impact tool according to the fifth embodiment of the present invention is moved maximally to the rear.

An annular plate 54 is provided in the casing 13, specifically, in the first housing chamber 17 as shown in FIG. 14. The plate 54 is provided about the axis A of the output shaft 21. The plate 54 is disposed between the cylindrical part 16*d* and the fan 27 in the direction along the axis A of the output shaft 21. The plate 54 is provided so as not to rotate in the casing 13. The plate 54 is disposed at a boundary part of the interior of the housing 14 and the interior of the gear cover 15. A housing chamber 63 which houses a later-described vibration reducing mechanism is formed between the plate 54 and the overhang part 16*c* in the direction along the axis A of the output shaft 21. The plate 54 is provided with a flat surface 64 perpendicular to the axis A of the output shaft 21. The flat surface 64 is the flat surface provided to be opposed to a constituent piece 49*a*. Furthermore, the overhang part 16*c* is provided with a flat surface 65 perpendicular to the axis A of the output shaft 21. The flat surface 65 is provided to be opposed to a constituent piece 49*b*.

The vibration reducing mechanism 47 is provided in the first housing chamber 17. The vibration reducing mechanism 47 is a mechanism for reducing the vibrations of the casing 13. The vibration reducing mechanism 47 has a supporting member 48, a weight 49, and others.

The weight 49 is also referred to as a counter weight. Hereinafter, the configuration of the vibration reducing mechanism 47 will be described in detail. A lower end part of the supporting member 48 is fixed to the cylindrical part 16*d* of the inner cover 16. The supporting member 48 is formed of, for example, a plate spring made of metal. The lower end part of the supporting part 48 is sandwiched by a mount member 50 which is provided below the bearing 24 and the inner cover 16, thereby being fixed to the inner cover 16. The mount member 50 is fixed to the inner cover 16 by two screws 51 penetrating through the supporting member 48. A pair of rubber members 52 is provided between the mount member 50 and the inner cover 16, and the lower end part of the supporting member 48 is sandwiched by the pair of rubber members 52.

In an initial state in which no force is working on the supporting member 48, the supporting member 48 is at a center position in the swinging direction of the later-described weight 49. Herein, the swinging direction of the weight 49 is a direction approximate to the direction in which the later-described piston 41 reciprocates along the center line C. The lateral surface of the supporting member 48 forms a planar shape, and the supporting member 48 is disposed so that a normal line of the lateral surface is in the direction along the front-rear direction of the casing 13. The above-mentioned "front-rear direction" is the direction which is the same as the reciprocating direction of the piston 41. "The lateral surface of the supporting member 48" means the surface perpendicular to the axis A of the output shaft 21 in the initial state. Furthermore, the "normal line" means a straight line perpendicular to the lateral surface of the supporting member 48. The supporting member 48 is provided with two arm parts 48*b* branched upward. Thus, the supporting member 48 has an approximately U-shape, and the weight 49 is provided so as to be across the two arm parts 48*b*. The weight 49 is fixed to the respective two arm parts 48*b* by screws. The weight 49 is elastically supported by the supporting member 48. The weight 49 forms an approximately trapezoidal shape in a lateral view.

The weight 49 is made up of the constituent piece 49*a* which is disposed on the rear side of the supporting member 48 and made of iron and the constituent piece 49*b* which is disposed on the front side of the supporting member 48 and made of iron. The constituent piece 49*a* and the constituent piece 49*b* are disposed at positions sandwiching an extended end part of the supporting member 48. A screw penetrating through the supporting member 48 is provided, and the constituent piece 49*a*, the supporting member 48, and the constituent piece 49*b* are mutually fixed by the screw.

Figure 13:
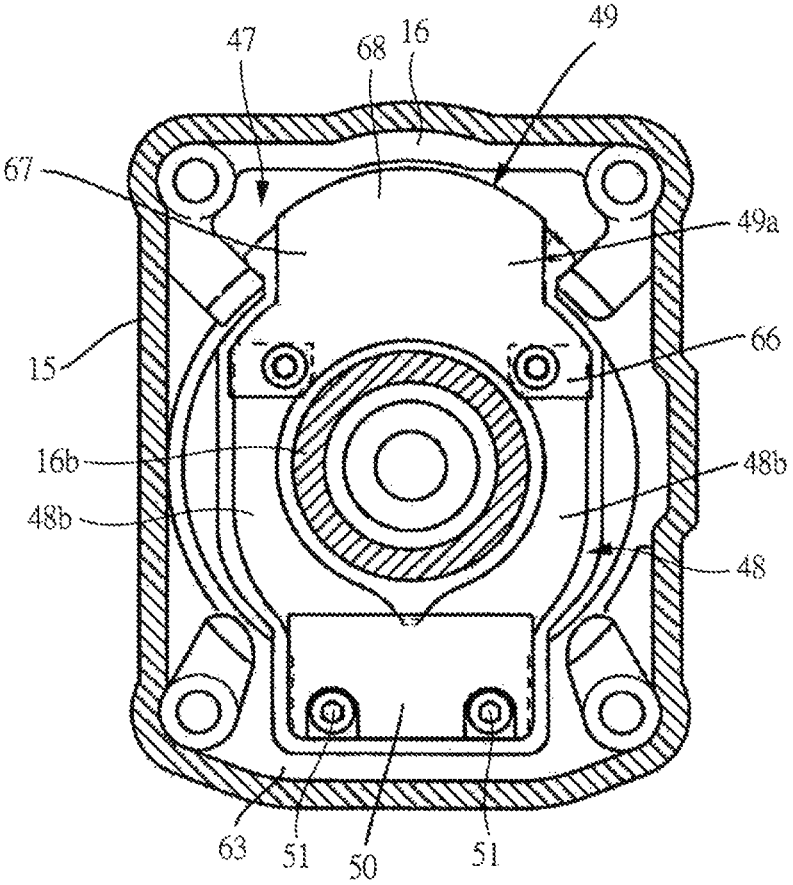
FIG. 13 is a cross-sectional view taken along the line II-II of FIG. 12.

As shown in FIG. 13, the constituent piece 49*a* has: a fixed part 66 which is fixed to the free end of the supporting member 48; a center part 67 which is positioned on the side above the fixed part 66 and has a width in the left-right direction of FIG. 13 narrower than the width of the fixed part 66; and a tip part 68 which is projecting upward from the center of the center part 67 in the left-right direction. The tip part 68 can be also referred to as a guided part. As shown in FIG. 14 and others, the constituent piece 49*b* has a fixed part 69 which is fixed to the extended end part of the supporting member 48 and a tip part 70 which is positioned on the side above the fixed part 69 and has a width in the left-right direction narrower than the width of the fixed part 69. Herein, the "width" means the size in the direction along the swinging direction of the weight 49.

By virtue of the above-described configuration, the weight 49 is supported to be swingable with respect to the inner cover 16 about the above-described "center position". The weight 49 swings at a predetermined vibration frequency. By this means, the vibrations due to the reciprocating motion of the piston 41, the striker 42, and the intermediate element 44 described later are reduced by the weight 49. The weight 49 is swingable within the range of a unique maximum amplitude determined by the spring constant of the supporting member 48.

The constituent piece 49*b* has a flat front-side end surface 71 opposed to the flat surface 65. The constituent piece 49*a* has a flat rear-side end surface 72 opposed to the flat surface 64. The front-side end surface 71 is inclined so that the distance from the center position of the weight 49 at the initial position is gradually reduced as increasing the distance from the swing axis point. In other words, the constituent piece 49*b* forms a trapezoidal shape in a lateral view. When the weight 49 reaches the swingable maximum amplitude and the weight 49 is positioned maximally to the front, the front-side end surface 71 comes closest to the flat surface 65. The swing axis point is the location which is present in the plane perpendicular to the reciprocating direction of the piston 41. In the fifth embodiment, the location at which the supporting member 48 is fixed to the cylindrical part of the inner cover 16 by the screw 51, in other words, the fixing position corresponds to the axis point of swinging of the weight 49.

The front-side end surface 71 of the constituent piece 49*b* has a first end part 73 which is closest to the swing axis point. The front-side end surface 71 of the constituent piece 49*b* has a second end part 74 which is away from the swing axis point compared with the first end part 73. The second end part 74 is positioned above the first end part 73. Herein, "above" is "in the left direction" in FIG. 14, and others. In this case, the shortest distance from the supporting member 48 to the part of the front-side end surface 71 corresponding to the first end part 73 is shorter than the shortest distance from the supporting member 48 to the part of the front-side end surface 71 corresponding to the second end part 74.

Similarly, the rear-side end surface 72 is inclined so that the distance from the center position of the weight 49 at the initial position in the swinging direction is gradually reduced as increasing the distance from the swing axis point. "The center position in the swinging direction" means the center position in the thickness direction of the weight 49 in the direction along the axis A. In other words, the constituent piece 49*a* forms a trapezoidal shape in a lateral view. When the amplitude of the weight 49 reaches the swingable maximum amplitude and the weight 49 is positioned maximally to the rear, the rear-side end surface 72 is closest to the flat surface 64.

Furthermore, the rear-side end surface 72 of the constituent piece 49*a* has a first end part 75 which is closest to the swing axis point. Moreover, the rear-side end surface 72 of the constituent piece 49*a* has a second end part 74 at a location away from the fixing position compared with the first end part 75. In other words, the first end part 75 is provided at a part of the rear surface at a position that is closer to the swing axis point than the free end of the weight 49. The second end part 76 is positioned above the first end part 75. In this case, the shortest distance from the supporting member 48 to the part of the rear-side end surface 72 corresponding to the first end part 75 is shorter than the shortest distance from the supporting member 48 to the part of the rear-side end surface 72 corresponding to the second end part 76. The extended end of the cylinder supporting part 62 is provided with a bearing retaining part 77. The bearing retaining part 77 forms an annular shape. As shown in FIG. 5 and FIG. 7, an annular bearing 39 made of a sintered material is fixed to the inner peripheral surface of the bearing retaining part 77 by swaging. The bearing 39 is a metal bearing. The above-described weight 49 and supporting member 48 constitute the vibration reducing mechanism 47.

Figure 12:
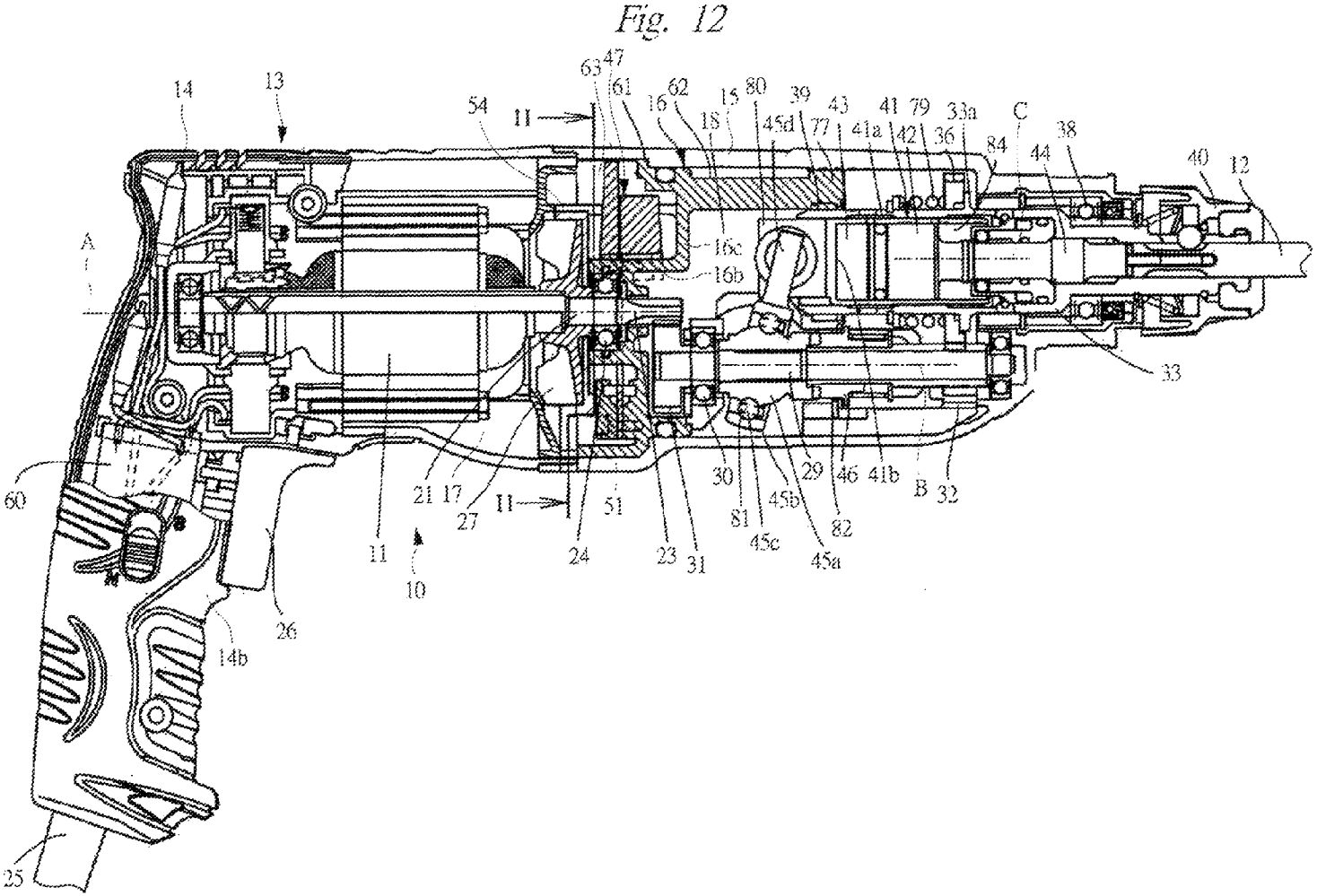
FIG. 12 is a cross-sectional view showing an impact tool according to the fifth embodiment of the present invention.

As shown in FIG. 12, an intermediate shaft 29 is provided below the inner cover 16 in the second housing chamber 18. The intermediate shaft 29 is disposed to be parallel to the output shaft 21 and is rotatably supported by the gear cover 15 and the inner cover 16 via two bearings 30. The intermediate shaft 29 is rotatable about the center line B.

A gear 31 is fixed to an end part on an electric motor 11 side corresponding to a rear end part of the intermediate shaft 29. The gear 31 is meshed with the output gear 23. A clutch 46 is attached to the intermediate shaft 29 on the front side of the gear 31. The clutch 46 rotates together with the intermediate shaft 29 and can be moved in the axial direction of the intermediate shaft 29. Also, a gear 32 is provided at the intermediate shaft 29 on the front side of the clutch 46. The gear 32 is meshed with a later-described gear 36.

A cylinder 33 is provided in the gear cover 15, specifically, in the second housing chamber 18. The axis of the cylinder 33 is extending in parallel to the center line B of the intermediate shaft 29. The cylinder 33 is rotatably supported by a bearing 39 of the cylinder supporting part 62 in the inner cover 16 and a bearing 38 in the gear cover 15. The gear 36 is attached to the outer periphery of the cylinder 33 in the vicinity of the gear 32. The gear 36 is movable in the direction along the center line C of the cylinder 33. The gear 36 is provided so as to be integrally rotated with the cylinder 33. When the torque of the gear 32 is transmitted to the gear 36, the cylinder 33 rotates about the center line C.

A disconnecting mechanism is provided at the outer periphery of the cylinder 33. The disconnecting mechanism is a mechanism which disconnects the power transmitting path between the gear 36 and the cylinder 33. The disconnecting mechanism is provided with a flange part 33*a* provided at a position of the cylinder 33 close to the gear 36 and a spring 79 which is provided on the opposite side of the flange part 33*a* with the gear 36 interposed therebetween and biases the gear 36 toward the flange part 33*a*.

When the tip tool 12 is rotated by the torque of the cylinder 33, the gear 36 is biased toward the flange part 33*a* by the spring 79, and the gear 36 and the cylinder 33 are integrally rotated. On the other hand, if the rotating speed of the tip tool 12 is reduced when the tip tool 12 digs into a material to be ground (not shown) or the like, the gear 36 is moved backward against the biasing force of the spring 79. Then, the engagement of the gear 36 and the flange part 33*a* is released. Therefore, the gear 36 spins free with respect to the cylinder 33, and the power of the gear 36 is no longer transmitted to the cylinder 33.

The end cover 40 to which the tip tool 12 is attached is provided at the front part of the cylinder 33. The end cover 40 has a tubular shape, and when the tip tool 12 is inserted into the end cover 40, the tip tool 12 is fixed to the end cover 40.

The piston 41 is provided in the cylinder 33. The piston 41 is reciprocable in the direction along the center line C of the cylinder 33 and is rotatable about the center line C of the cylinder 33.

The piston 41 is integrally formed from a cylindrical part 41*a*, a bottom part 41*b*, and a connecting part 80. The cylindrical part 41*a* forms an approximately cylindrical shape whose front end is open and whose rear end is closed by the bottom part 41*b*. The inner peripheral surface of the cylindrical part 41*a* and the inner surface of the bottom part 41*b* are integrally connected. As shown in FIG. 1, the inner peripheral surface of the cylindrical part 41*a*, the inner surface of the bottom part 41*b*, and the striker 42 form a pneumatic chamber 43. In other words, the pneumatic chamber 43 is provided in the piston 41. The connecting part 80 is disposed across the cylinder 33 from a space 83 below the cylinder supporting part 62. In other words, the connecting part 80 is provided on the rear end side of the cylindrical part 41*a*, and the connecting part 80 is coupled to a later-described arm part, that is, a coupling rod 45*d*.

The striker 42 is provided in an interior space 84 of the cylindrical part 41*a* of the piston 41. The striker 42 is movable in the direction along the center line C with respect to the piston 41. When the piston 41 is moved from the rear side toward the front side, the air in the pneumatic chamber 43 is compressed to generate the impact force. The impact force is transmitted to the striker 42 to move the striker 42 to the front side. An intermediate element 44 is provided in the cylinder 33 and between the striker 42 and the tip tool 12. A rear end of the intermediate element 44 can abut on the striker 42, and a front end thereof can abut on the tip tool 12 retained by the end cover 40. The intermediate element 44 is movable in the direction along the center line C of the cylinder 33. When the striker 42 strikes the intermediate element 44, the impact force thereof is applied to the top tool 12 via the intermediate element 44.

On the other hand, an inner ring 45*a* serving as a cam part is provided between the gear 31 and the clutch 46 in the direction along the center line B of the intermediate shaft 29. The inner ring 45*a* is formed to have a spherical shape, and the intermediate shaft 29 is inserted in a shaft hole penetrating through the inner ring 45*a*. The inner ring 45*a* and the intermediate shaft 29 can rotate relatively. An annular groove 81 is formed in the outer surface of the inner ring 45*a* along the circumferential direction about the center line B of the intermediate shaft 29. A change lever 82 is provided in a lower part of the gear cover 15 and at a position close to the clutch 46. The change lever 82 is operated by the user of the impact tool 10. The change lever 82 is provided in order to switch the movement of the clutch 46. When the clutch 46 is moved, the inner ring 45*a* and the intermediate shaft 29 are brought into a connected state or a non-connected state.

For example, when the change lever 82 is not operated, the inner ring 45*a* and the intermediate shaft 29 are normally not connected with each other. When the inner ring 45*a* and the intermediate shaft 29 are in the non-connected state, the power of the intermediate shaft 29 is not transmitted to the inner ring 45*a*. On the other hand, when the change lever 82 is operated, the clutch 46 is moved in the direction along the axis of the intermediate shaft 29. When the change lever 82 is operated and the clutch 46 is moved to the rear side along the intermediate shaft 29, the inner ring 45*a* and the intermediate shaft 29 are connected to each other. In other words, the state in which the power of the intermediate shaft 29 is transmitted to the inner ring 45*a* is obtained.

The inner ring 45*a* is provided with an outer ring 45*b*. The outer ring 45*b* is formed to have an approximately annular shape. The outer ring 45*b* is provided so as to surround the inner ring 45*a*. A plurality of rolling elements 45*c* are interposed between the outer ring 45*b* and the inner ring 45*a*. The plurality of rolling elements 45*c* are provided so that they can roll along the groove 81. The rolling elements 45*c* include balls made of metal. The coupling rod 45*d* projecting from the outer peripheral surface of the outer ring 45*b* is provided. The coupling rod 45*d* is coupled to the connecting part 80 of the piston 41. Therefore, the rotary motion of the inner ring 45*a* is converted to reciprocating motion of the piston 41. The inner ring 45*a*, the outer ring 45*b*, the rolling elements 45*c*, and the coupling rod 45*d* constitute the motion converting mechanism 45.

When a user carries out the working with the impact tool 10 having the above-described configuration, the user can select a first mode in which the tip tool 12 is rotated or a second mode in which the tip tool 12 is rotated and impact force is applied thereto by the operation of the change lever 82. If the change lever 82 is not operated, the first mode is selected. If the change lever 82 is operated, the second mode is selected.

If the user selects the second mode, the state in which the inner ring 45*a* and the intermediate shaft 29 are connected to each other is obtained. Then, when the trigger 26 is pulled to supply electric power to the electric motor 11, the torque of the output shaft 21 is transmitted to the intermediate shaft 29 via the gear 31. The torque of the intermediate shaft 29 is transmitted to the cylinder 33 via the gear 32 and the gear 36. In this manner, the cylinder 33 is rotated, and the tip tool 12 is operated to rotate.

On the other hand, the rotary motion of the intermediate shaft 29 is converted to reciprocating motion of the piston 41 by the motion converting mechanism 45. When the piston 41 reciprocates, the air in the pneumatic chamber 43 is compressed, and impact force is generated. The impact force is transmitted to the tip tool 12 via the striker 42 and the intermediate element 44.

When the piston 41, the intermediate element 44, the striker 42, and the tip tool 12 reciprocate in this manner, the impact tool 10 vibrates in the direction along the center line C of the piston 41. Herein, the actual vibration frequency of the impact tool 10 and the unique vibration frequency of the impact tool 10 sometimes match. As a result, the weight 49 swings about the swing axis point at the unique vibration frequency of the supporting member 48. Since the direction of the swinging of the weight 49 approximately matches the front-rear direction which is the reciprocating direction of the piston 41, the vibrations of the impact tool 10 can be reduced.

Moreover, the constituent piece 49*b* of the swinging weight 49 is provided with the front-side end surface 71. Furthermore, the constituent piece 49*a* is provided with the flat rear-side end surface 72. Moreover, the shortest distance from the supporting member 48 to the part of the front-side end surface 71 corresponding to the first end part 73 is shorter than the shortest distance from the supporting member 48 to the part of the front-side end surface 71 corresponding to the second end part 74. Furthermore, the shortest distance from the supporting member 48 to the part of the rear-side end surface 72 corresponding to the first end part 75 is shorter than the shortest distance from the supporting member 48 to the part of the rear-side end surface 72 corresponding to the second end part 76.

The thickness and the disposed position of the overhang part 16*c* are determined so that the first end part 73 and the second end part 74 of the front-side end surface 71 do not contact the flat surface 65 when the weight 49 swings and the amplitude of the weight 49 reaches the maximum amplitude. The thickness and the disposed position of the overhang part 16*c* mean the thickness and the disposed position thereof in the direction along the axis A. Furthermore, the thickness and the disposed position of the plate 54 are determined so that the first end part 75 and the second end part 76 of the rear-side end surface 72 do not contact the flat surface 64 when the weight 49 swings and the amplitude of the weight 49 reaches the maximum amplitude. The thickness and the disposed position of the plate 54 mean the thickness and the disposed position thereof in the direction along the axis A. Therefore, the length of the housing space that houses the swinging weight 49 can be minimized in the direction along the axis A, and the impact tool 10 can be downsized.

Moreover, since the weight 49 is supported by the supporting member 48, the weight 49 can be swung by the simple configuration by utilizing the elastic force of the supporting member 48.

The lower end part of the supporting member 48 is fixed to the inner cover 16, and the upper end part of the supporting member 48 is fixed to the weight 49. The weight 49 is supported by the supporting member 48. Therefore, the degree of freedom of designing the configuration to support the weight 49 can be enhanced. Moreover, in the manufacturing process of the impact tool 10, the assembly of the configuration to support the weight 49 by the housing 14 can be facilitated.

The impact tool of the fifth embodiment of the present invention is not limited to the above-described embodiment, and various modifications and improvements can be made within the range described in claims. For example, in the present embodiment, the front-side end surface 71 of the weight 49 reaches its closest point to the flat surface 65 when the amplitude of the weight 49 reaches the swingable maximum amplitude and the weight 49 is positioned maximally to the front. The positional relation between the front-side end surface 71 and the flat surface 65 may be determined so that the front-side end surface 71 and the flat surface 65 become parallel to each other when the weight 49 is positioned maximally to the front. The "parallel" mentioned here means not only the case in which they are completely parallel to each other, but also includes the case in which they are somewhat not parallel to each other due to size errors or the like.

Herein, the first end part 73 of the constituent piece 49*b* and the second end part 74 of the constituent piece 49*b* will be focused on. In this case, when the amplitude of the weight 49 reaches the maximum amplitude in the front direction, the distance from the part of the front-side end surface 71 corresponding to the first end part 73 to the flat surface 65 and the distance from the part of the front-side end surface 71 corresponding to the second end part 74 to the flat surface 65 become approximately equal to each other. Herein, "the distance" is the distance along the axis A.

Similarly, the first end part 75 of the constituent piece 49*a* and the second end part 76 of the constituent piece 49*a* will be focused on. In this case, when the amplitude of the weight 49 reaches the maximum amplitude in the rear direction, the distance from the part of the rear-side end surface 72 corresponding to the first end part 75 to the flat surface 64 and the distance from the part of the rear-side end surface 72 corresponding to the second end part 76 to the flat surface 64 become approximately equal to each other. Herein, "the distance" is the distance along the axis A. Moreover "equal to each other" means not only the case in which they are completely equal to each other, but also includes the case in which they are somewhat not equal to each other due to size errors or the like.

The plate spring is not limited to the supporting member 48 having the shape of the present embodiment. Also, although the weight 49 is supported by the supporting member 48, the weight 49 may be supported by any other member instead of the supporting member 48 as long as the weight 49 is swingably supported by an elastic member.

The housing 14 is formed as an outer shell serving as an outer casing, and the inner cover 16 is disposed in the housing 14. However, the configuration of the housing 14 is not limited to this configuration.

The weight 49 is configured to have the constituent piece 49*b* and the constituent piece 49*a*. However, the weight 49 is not limited to this configuration. For example, the weight 49 may be configured to have only the constituent piece 49*b*.

Both of the front-side end surface 71 and the rear-side end surface 72 of the weight 49 are inclined so that the shortest distances from the swinging center position of the weight 49 at the initial position are gradually reduced as increasing the distances from the swing axis point. However, only either one of them may be inclined in this manner. More specifically, only either one of the front-side end surface 71 and the rear-side end surface 72 of the weight 49 may have the configuration in which the shortest distance from the supporting member 48 to the second end part is shorter than the shortest distance from the supporting member 48 to the first end part. The correspondence relation between the configuration of the present embodiment and the configuration of the present invention will be described. The weight 49 corresponds to a counter weight of the present invention. The direction along the axis A, the direction along the center line B, and the direction along the center line C are mutually parallel directions. The direction along the center line C corresponds to the "reciprocating direction" of the present invention. The front-side end surface 71 corresponds to an opposing surface of the present invention.

In the fifth embodiment, the hammer drill is described as an example of the impact tool 10. However, the impact tool is not limited to a hammer drill, but can be applied to an impact tool having a reciprocating member. The impact tool of the present invention is particularly useful in the field of, for example, hammer drills for which vibrations generated by the reciprocating member are required to be reduced.

INDUSTRIAL APPLICABILITY

The present invention can be utilized in an impact tool capable of converting power of an electric motor to impact force and applying the impact force to a tip tool like a hammer drill, a hammer driver, and others.

The invention claimed is:

1. An impact tool comprising:

a casing that supports a tip tool;

a moving member that is reciprocatably provided in the casing and generates impact force to be transmitted to the tip tool;

an electric motor that is provided in the casing and has an output shaft;

a motion converting mechanism that is provided in the casing, converts rotary motion of the output shaft to reciprocating motion, and transmits the reciprocating motion to the moving member; and a vibration reducing mechanism that is movably provided in the casing and reduces a vibration of the casing, wherein the vibration reducing mechanism includes:

a supporting member that is provided to be swingable in a direction of a center line of reciprocation of the moving member with using a fixing position provided on the casing as a supporting point; and a weight that is attached to a location of the supporting member close to a free end relative to the fixing position, in a plane including the center line, a gravity center of the weight and the fixing position are disposed at mutually different locations in a radial direction of the center line, in the plane including the center line, the fixing position is disposed on a side of a gravity center of the impact tool relative to the center line, the supporting member has a hole penetrating therethrough in a direction along an axis of the output shaft, and the output shaft is inserted in the hole.

2. The impact tool according to claim 1, wherein, in the plane including the center line, the gravity center of the impact tool is disposed between the fixing position and the gravity center of the weight, and in the plane including the center line, the center line is disposed between the gravity center of the weight and the gravity center of the impact tool.

3. The impact tool according to claim 1, wherein the axis of the output shaft is disposed to be parallel to and non-coaxial with the center line.

4. The impact tool according to claim 1, wherein the electric motor has a coil that forms a rotating magnetic field by distribution of electric power, the motion converting mechanism has a rotatable power transmitting shaft, a first gear provided at the output shaft and a second gear provided at the power transmitting shaft mesh with each other, and the vibration reducing mechanism is disposed between the first gear and the coil in a direction along the axis of the output shaft.

5. The impact tool according to claim 1, wherein the vibration reducing mechanism is disposed between the electric motor and the motion converting mechanism.

6. The impact tool according to claim 1, further comprising:

a bearing that is provided in the casing and supports the output shaft, wherein the bearing and the vibration reducing mechanism are disposed so as to be at least partially overlapped with each other in a direction along the center line of the moving member.

7. The impact tool according to claim 6, wherein the vibration reducing mechanism includes:

a supporting member that is fixed to the casing in a cantilever state so as to be swingable in the direction along the center line; and a weight attached to the free end of the supporting member.

8. The impact tool according to claim 7, wherein the weight has a shape whose width from the supporting member serving as a center is larger on an opposite side of the electric motor.

9. The impact tool according to claim 8, further comprising:

an intermediate shaft that transmits power of the output shaft to the tip tool, wherein the weight is disposed on an opposite side of the intermediate shaft with interposing the output shaft therebetween.

10. The impact tool according to claim 6, wherein the electric motor has a coil that forms a rotating magnetic field by distribution of electric power, the motion converting mechanism has a power transmitting shaft that is disposed to be parallel to the center line and is rotatable, a first gear provided at the output shaft and a second gear provided at the power transmitting shaft mesh with each other, the vibration reducing mechanism is disposed between the first gear and the coil in the direction along the center line, the vibration reducing mechanism has a hole or a recessed part that is penetrating therethrough in the direction along the center line, and the output shaft is inserted in the hole or the recessed part.

11. The impact tool according to claim 6, wherein the casing has a cylindrical part that is formed so as to surround an axis of the output shaft, the output shaft is inserted in the cylindrical part, the bearing is attached to an inner peripheral surface of the cylindrical part and supports the output shaft, a hole that is penetrating through the vibration reducing mechanism in the direction along the center line is provided, and the cylindrical part is inserted in the hole.

12. The impact tool according to claim 1, wherein the weight has a trapezoidal shape whose size in a swinging direction along the center line is reduced as increasing a distance from the fixing position.

13. The impact tool according to claim 12, wherein the weight has a first end part that is provided at a location close to the fixing position relative to the free end of the supporting member and has a second end part that is provided at a location close to the free end of the supporting member compared with the first end part, the casing has a weight-opposing flat surface that is opposed to the end part of the weight in the swinging direction, and when the swinging motion of the weight reaches a maximum amplitude, a distance from the first end part to the weight-opposing flat surface and a distance from the second end part to the weight-opposing flat surface are equal to each other in the direction along the center line.

14. The impact tool according to claim 13, wherein an end part of the weight in the direction along the center line is provided with an opposing surface opposed to the casing, and when the swinging motion of the weight reaches the maximum amplitude, the weight-opposing flat surface and the opposing surface become parallel to each other in a plane including the center line.

15. The impact tool according to claim 12, wherein the casing includes:

an outer casing that constitutes an outer shell; and an inner casing that is disposed in the outer casing, and the weight is supported by a plate spring having one end part fixed to the inner casing.

16. The impact tool according to claim 12, wherein an end part of the weight in the direction along the center line is provided with an opposing surface opposed to the casing, and a distance from a center position of the weight to the opposing surface in the direction along the center line is reduced as being closer to the free end from the fixing position.

* * * * *